US007077061B2

(12) United States Patent
Holm et al.

(10) Patent No.: US 7,077,061 B2
(45) Date of Patent: Jul. 18, 2006

(54) DRIVES FOR A PRINTING GROUP

(75) Inventors: Helmut Holm, Erlabrunn (DE); Peter Jentzsch, Rottendorf (DE); Erich Max Karl Gerner, Bütthard (DE); Petra Jemiller, Tauberbischofsheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 156 days.

(21) Appl. No.: 10/493,320

(22) PCT Filed: Nov. 6, 2002

(86) PCT No.: PCT/DE02/04105

§ 371 (c)(1),
(2), (4) Date: May 5, 2004

(87) PCT Pub. No.: WO03/039873

PCT Pub. Date: May 15, 2003

(65) Prior Publication Data

US 2005/0016399 A1 Jan. 27, 2005

(30) Foreign Application Priority Data

| | | |
|---|---|---|
| Nov. 8, 2001 | (DE) | 101 54 837 |
| Nov. 8, 2001 | (DE) | 101 54 838 |
| Dec. 23, 2001 | (DE) | 101 63 961 |
| Dec. 23, 2001 | (DE) | 101 63 962 |
| Dec. 23, 2001 | (DE) | 101 63 963 |
| Jul. 3, 2002 | (DE) | 102 29 787 |

(51) Int. Cl.
*B41F 13/00* (2006.01)

(52) U.S. Cl. ..... 101/212; 101/216; 101/352.06

(58) Field of Classification Search ..... 101/212, 101/219, 141, 352.06
See application file for complete search history.

(56) References Cited

U.S. PATENT DOCUMENTS

| | | | |
|---|---|---|---|
| 2,115,734 | A | 5/1938 | Lamatsch |
| 2,282,655 | A | 5/1942 | Huck |
| 3,732,815 | A | 5/1973 | Greiner et al. |
| 3,742,849 | A | 7/1973 | Greiner et al. |
| 4,000,691 | A | 1/1977 | Fischer |
| 4,088,074 | A | 5/1978 | Dahlgren et al. |
| 4,424,744 | A | 1/1984 | Harper et al. |
| 4,606,269 | A | 8/1986 | Jeschke et al. |
| 4,686,901 | A | 8/1987 | Arndt et al. |
| 4,729,309 | A | 3/1988 | Saterini et al. |
| 5,191,835 | A | 3/1993 | Blanchard |
| 5,706,725 | A | 1/1998 | Kolbe et al. |
| 5,713,281 | A | 2/1998 | Hummel et al. |

(Continued)

FOREIGN PATENT DOCUMENTS

| | | |
|---|---|---|
| DE | 2 014 070 | 10/1971 |

(Continued)

*Primary Examiner*—Andrew H. Hirshfeld
*Assistant Examiner*—Marissa Ferguson-Samreth
(74) *Attorney, Agent, or Firm*—Jones, Tullar & Cooper, P.C.

(57) ABSTRACT

A printing group, which includes at least one rotation element, that can be rotated about its longitudinal direction, and than can also be displaced axially, includes a drive. That drive for the rotational element can be a drive motor which is independent of the drive of the printing group cylinders. The drive can be effected through a rotationally fixed and coaxially linked drive wheel, and a flexible drive. In order to achieve a lateral travel of the rotational element, the printing group is provided with a supplementary drive motor.

112 Claims, 17 Drawing Sheets

U.S. PATENT DOCUMENTS

| | | | | |
|---|---|---|---|---|
| 5,826,505 | A | 10/1998 | Volz et al. | |
| 6,220,159 | B1 | 4/2001 | Wieland | |
| 6,289,805 | B1 | 9/2001 | Douillard et al. | |
| 6,298,779 | B1 | 10/2001 | Gotanda et al. | |
| 6,311,617 | B1 * | 11/2001 | Herden et al. | 101/350.3 |
| 6,334,389 | B1 | 1/2002 | Fischer | |
| 6,408,748 | B1 | 6/2002 | Hajek et al. | |
| 6,578,481 | B1 * | 6/2003 | Beisel et al. | 101/350.3 |
| 6,644,184 | B1 | 11/2003 | Hajek et al. | |

FOREIGN PATENT DOCUMENTS

| | | | |
|---|---|---|---|
| DE | 2 014 753 | | 10/1971 |
| DE | 23 09 850 | | 2/1975 |
| DE | 29 32 105 | | 2/1981 |
| DE | 33 27 872 | A1 | 5/1984 |
| DE | 34 09 194 | A1 | 9/1985 |
| DE | 33 27 872 | C2 | 6/1986 |
| DE | 36 20 156 | C2 | 1/1987 |
| DE | 42 04 604 | A1 | 8/1993 |
| DE | 44 30 693 | A1 | 3/1996 |
| DE | 195 05 625 | C2 | 12/1996 |
| DE | 195 19 141 | A1 | 12/1996 |
| DE | 196 03 663 | A1 | 8/1997 |
| DE | 196 23 224 | C1 | 9/1997 |
| DE | 197 55 316 | A1 | 6/1999 |
| DE | 197 55 316 | C2 | 10/1999 |
| EP | 0 234 456 | A2 | 9/1987 |
| EP | 0 462 490 | A1 | 12/1991 |
| EP | 0 699 524 | A2 | 3/1996 |
| EP | 0 644 048 | B1 | 7/1999 |
| EP | 1 125 734 | A1 | 8/2001 |
| GB | 2309668 | * | 1/1980 |
| GB | 2 309 668 | A | 6/1997 |
| JP | 56021860 | A | 2/1981 |
| WO | WO 99/08873 | | 2/1999 |

* cited by examiner

DRIVES FOR A PRINTING GROUP

FIELD OF THE INVENTION

The present invention is directed to drive mechanisms of a printing group. The printing group typically includes at least one cylinder or rotatable body which is rotatable about its longitudinal axis and which is also axially movable.

BACKGROUND OF THE INVENTION

A drive mechanism of a printing group is known from U.S. Pat. No. 4,088,074. A drive motor can be provided for the purpose of the rotatory driving of an application roller. The axial driving of distribution cylinders, which are rotatorily driven by friction, is provided via a lever mechanism that is driven by a pressure medium piston.

DE 44 30 693 A1 shows a printing group with an inking and a dampening system. The distribution cylinders of the inking cylinder can each be axially driven by their own drive motor, or in one preferred embodiment, together by a drive motor via a gear wheel connection. An axial stroke can be created at each one of the distribution cylinders by linear motors.

DE 29 32 105 A1 discloses a drive mechanism of distribution cylinders of a dampening system. A distribution cylinder can be driven individually, or together with a water fountain roller of a distribution roller, independently of the printing group cylinders by the use of a drive motor. The drive mechanism of the distribution cylinder is represented by a traction mechanism.

The drive mechanism of a printing group is known from U.S. Pat. No. 6,298,779. A drive wheel is connected with an axially movable distribution cylinder for the purpose of rotatory driving. The drive wheel can be driven by a gear wheel arranged on a shaft, wherein the shaft can be selectively driven by a further gear wheel or by a toothed belt from a drive motor. Further distribution cylinders can be driven via a wheel train, for example.

A drive mechanism for a distribution cylinder is known from WO 99/08873 A1, which distribution cylinder can be rotatorily driven via a wheel train, and in the axial direction by a crank drive mechanism. The lift or axial displacement is generated via an eccentric device and is transferred to the distribution cylinder via couplings.

An axial drive mechanism for two distribution cylinders is known from DE 33 27 872 C2. A drive mechanism for generating the axial movement of the two distribution cylinders is embodied as being encapsulated.

DE 23 09 850 B2 discloses a rotatory drive mechanism for distribution cylinders of an inking system. A distribution cylinder, that is located near the printing position, is driven by the printing cylinder via gear wheels. The other distribution cylinder is driven from the first distribution cylinder via a toothed belt and beveled disk wheels.

In DE 42 04 604 A1 two distribution cylinders are rotatorily, as well as axially, driven via a wheel train. The conversion of rotary to axial movement is provided by a worm drive.

DE 195 05 625 has a distribution cylinder whose rotatory, as well as axial, driving is provided by a drive unit via a belt drive.

SUMMARY OF THE INVENTION

The object of the present invention is directed to providing drive mechanisms for a printing group.

In accordance with the present invention, this object is attained by the provision of a drive mechanism for the printing group which typically includes a drive for at least one rotating body that is rotatable about its longitudinal axis and that is also movable in the axial direction. The at least one rotating body can have one drive mechanism for causing the rotational movement and a separate drive for generating the axial displacement.

The advantages which can be obtained by the present invention consist, in particular, in that a high degree of flexibility of the operation of the printing group is offered. At the same time, a large outlay for mechanical and electronic devices, for drive technology and for the sealing of an extensive oil chamber are avoided.

In one embodiment, provided with printing group cylinders driven individually or in pairs, and with rollers of an inking or dampening unit also driven individually or in pairs, for example distribution cylinders, encapsulation individually or in pairs provides considerable advantages in regard to the outlay and to structural space on the driving side. The construction and sealing of an extensive oil chamber between lateral walls of the printing press is no longer required.

In comparison with an axial rotatory driving of the cylinders, rollers or distribution cylinders directly via a motor shaft, driving of the cylinders or rollers via a gear satisfies the requirement for optimal rpm ranges. This is of great advantage, in particular in the case of an inking or a dampening system with distribution cylinders, in view of the "erratic" and uneven stresses caused by back-and-forth moving distribution cylinders.

In an advantageous embodiment of the present invention, the separation of the rotatory and axial movements in accordance with drive technology, makes possible, on the one hand, an oil-free and therefore a cost-effective and environmentally gentle embodiment. Moreover, it opens up increased flexibility through technological processes. For example, during a start-up phase of the printing press, it is possible to perform the inking or dampening of the inking unit or of the dampening unit without a back-and-forth movement. During printing, the frequency of the back-and-forth movements can be set independent of the number of revolutions of the distribution cylinders or the production speed. For example, this frequency can be kept constant during changing operating conditions. In this way, an optimum ratio between lateral movements and circumferential speeds can be set without requiring adjustable gears and an oil chamber. Also, in an advantageous manner, it is possible to set and to change the turning point of the back-and-forth movement in the circumferential direction in respect to the position of the rollers or cylinders. This provides advantages, for example, in case of cylinders with fastening grooves. The independence of the rotatory drive mechanism from the drive mechanism of the forme cylinder, in particular one driven by an individual drive motor, also opens the possibility, on the other hand, of varying the circumferential speeds between the forme cylinder and the distribution cylinder and of achieving a high flexibility in set-up operations, such as washing, printing forme changes, pre-inking, rubber blanket washing, etc., chronologically independent of each other.

If a structural component of, for example, the inking unit, has several rollers, which must be driven, or has several distribution cylinders, which must be driven, a drive motor for moving all of the distribution cylinders of this structural component in the axial direction is advantageous. Unnecessary control mechanisms and an unnecessarily large error potential can be avoided.

An embodiment of the present invention is particularly advantageous in respect to flexibility, effectiveness, dependability and outlay, in which the two printing group cylinders of the printing group have at least one independent drive motor, the rollers which must be driven, for example the distribution cylinders of the inking unit, and the rollers which must be driven, or the distribution cylinder(s) of the dampening unit, if provided, have their own rotatory drive mechanism per group, possibly via a separately encapsulated gear and/or a traction mechanism gear. These last mentioned structural components then each have their own common drive motor for the axial movement, for example, wherein driving takes place, for example, via a crank drive whose lift or axial displacement can be adjusted.

In a preferred embodiment of the drive mechanism of the present invention, in the form of a traction mechanism gear, this permits, for one, the common drive of the components which, as a rule, are synchronously driven, without an extensive wheel train. It also provides the opportunity of providing the drive mechanism without an oil chamber and the structural arrangements connected therewith.

The embodiment of the gear by the use of a toothed belt can be configured to be less vulnerable to possible flank changes during these movements than a wheel train.

BRIEF DESCRIPTION OF THE DRAWING

Preferred embodiments of the present invention are represented in the drawings and will be described in greater detail in what follows.

Shown are in.

DESCRIPTION OF PREFERRED EMBODIMENTS

Figure 1:
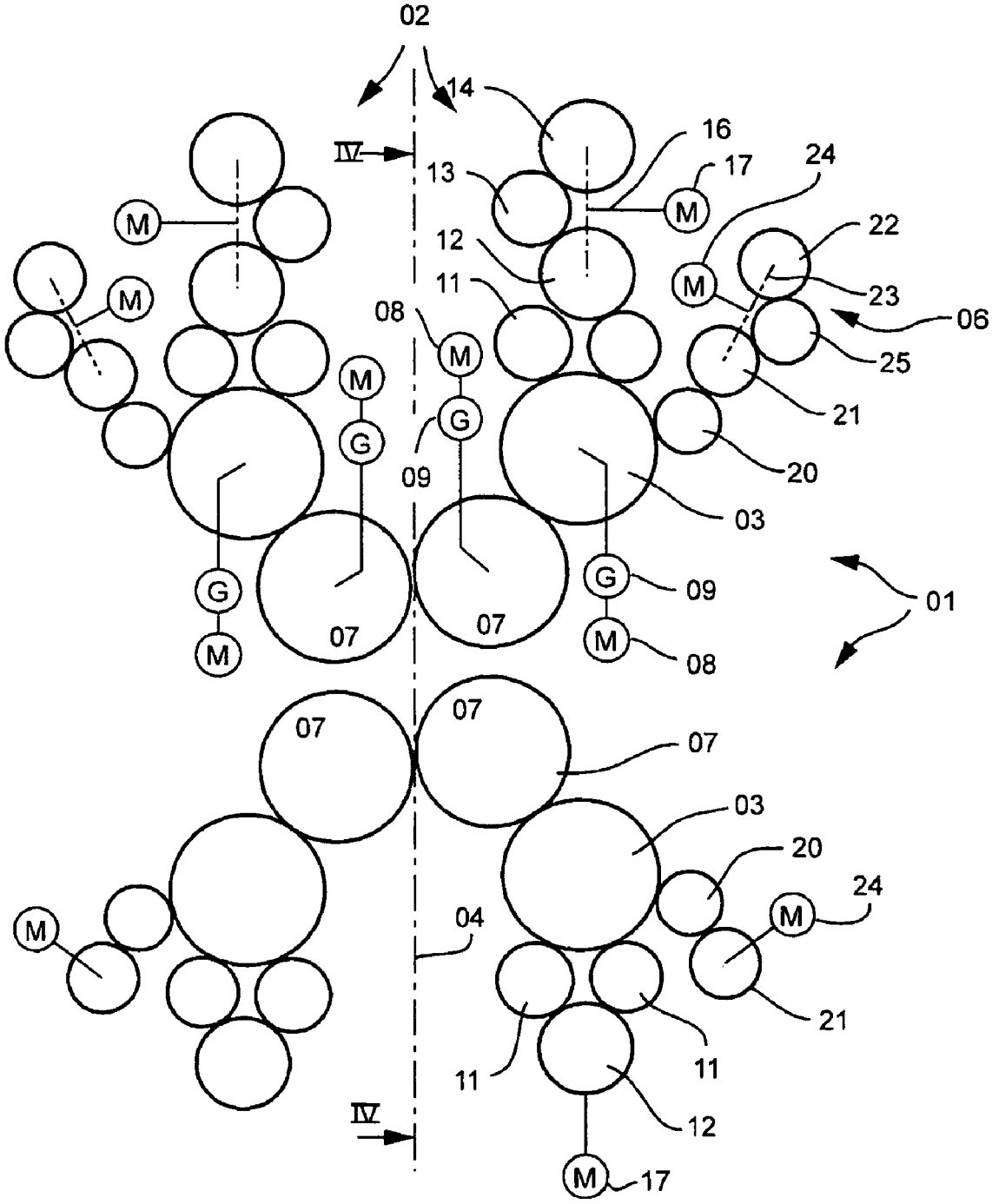
FIG. 1, a schematic representation of a printing unit having four printing groups in a "rubber against rubber" embodiment, in FIG. 2, a schematic representation of a printing unit having four printing groups in a "satellite printing unit" embodiment, in FIG. 3, a side view of the drive mechanisms in FIG. 1, in FIG. 4, a side view of the drive mechanisms in FIG. 2, in FIG. 5, a schematic representation of a printing unit containing four printing groups and provided with a belt drive, in FIG. 6, an oblique, perspective view of a first preferred embodiment of the drive mechanism of an inking unit by reference to the example of the upper right printing group in FIG. 1, in FIG. 7, a partial section through the drive mechanism in accordance with FIG. 2, in FIG. 8, an oblique, perspective view of a first preferred embodiment of the drive mechanism of an inking unit by reference to the example of the lower right printing group in FIG. 1, in FIG. 9, a partial section through the drive mechanism in accordance with FIG. 4, in FIG. 10, an oblique, perspective view of a first preferred embodiment of the drive mechanism of a dampening unit by reference to the example of the upper right printing group in FIG. 1, in FIG. 11, a partial section through the drive mechanism in accordance with FIG. 7, in FIG. 12, an oblique, perspective view of a first preferred embodiment of the drive mechanism of a dampening unit by reference to the example of the lower right printing group in FIG. 1, in FIG. 13, a partial section through the drive mechanism in accordance with FIG. 8, in FIG. 14, a schematic representation of another preferred embodiment of a printing unit in accordance with the present invention, with a belt drive containing four printing groups, in FIG. 15, a schematic representation of a further preferred embodiment of a printing unit for axial driving, in FIG. 16, a schematic representation of a further preferred embodiment of a printing unit for axial driving, in FIG. 17, a schematic representation of a further preferred embodiment of a printing unit for axial driving, in FIG. 18, a schematic representation of a further preferred embodiment of a printing unit for axial driving, in FIG. 19, a schematic representation of a further preferred embodiment of a printing unit for axial driving, in FIG. 20, a schematic representation of a crank drive driven by a traction mechanism, and in FIG. 21, a schematic representation of a roller axially driven by means of a cam disk.

A printing press, and in particular a rotary printing press, has, as seen in FIG. 1 at least one printing group 01, by the operation of which, ink from an inking unit 02 can be applied via at least one rotating body 03 embodied as a cylinder 03, for example as a forme cylinder 03, to a material 04 to be imprinted, for example a web of material 04 to be imprinted, hereinafter referred to as a web 04, for short. In the first preferred embodiment of a printing unit for rubber against rubber printing on both sides of web 04, as seen in FIG. 1, the printing group 01 is embodied as an offset printing group 01 for wet offset printing and thus further has a dampening unit 06 and a further rotating body 07, which is embodied as a cylinder 07, typically a so-called transfer cylinder 07. Together with a counter-pressure cylinder constituting a thrust element, the transfer cylinder 07 forms a printing position. In the configuration of FIG. 1, the counter-pressure cylinder is embodied as a transfer cylinder 07 of a second, cooperating printing group 01. In this embodiment, the two cooperating printing groups 01 constitute a so-called double printing group for use in imprinting both sides of web 04. Similar elements will be provided with identical reference symbols to the extent that this is not needed for differentiation. However, there can be a difference in the spatial position and, as a rule, this difference will not be considered in case identical reference symbols are issued.

Figure 2:
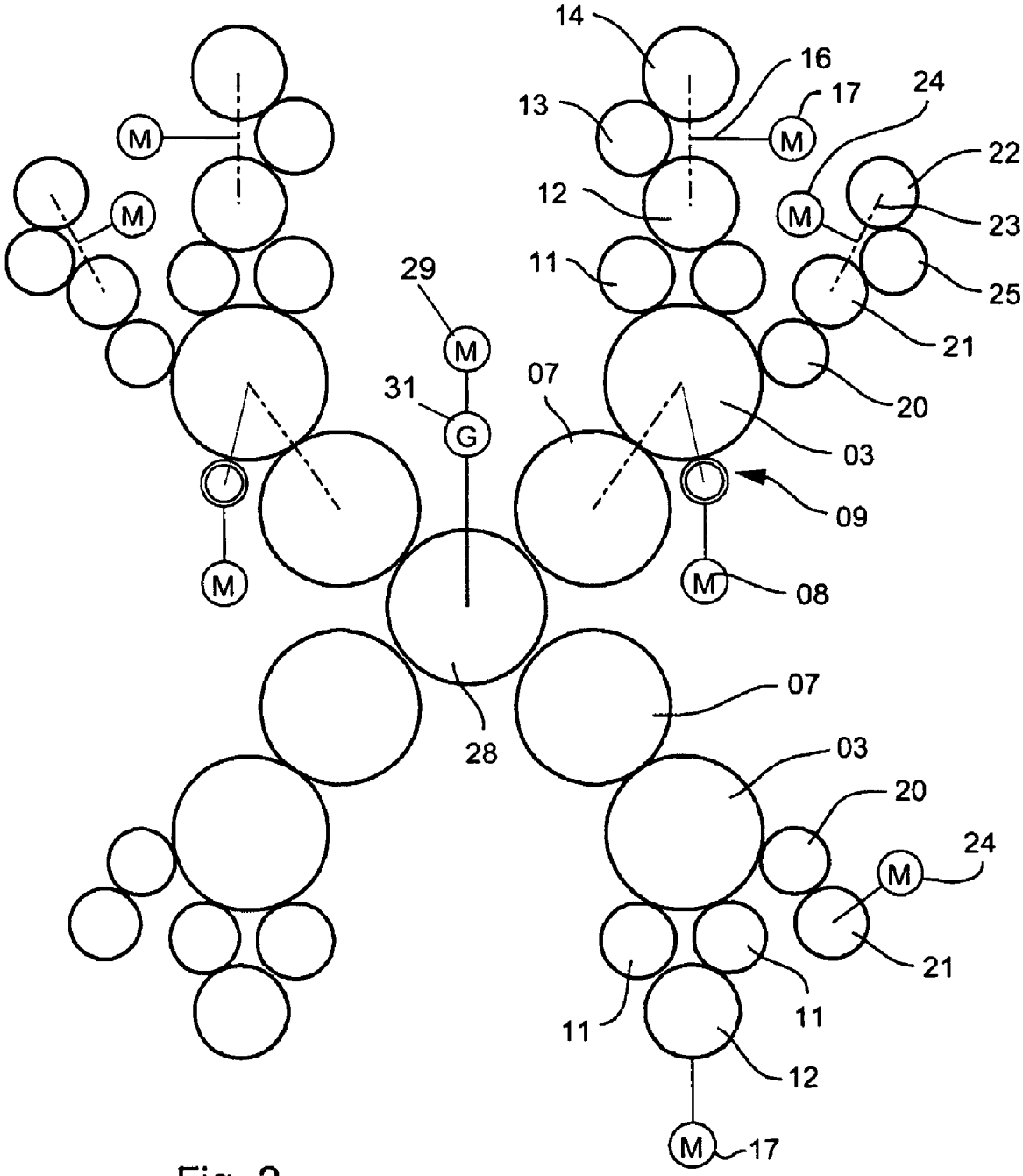

In an advantageous embodiment of the present invention, the cylinders 03, 07, which are also called printing group cylinders 03, 07, each have a drive motor 08, which drive motor 08 is independent of further printing groups 01, at least for the pairs for the printing group 01, as represented, by way of example, in FIG. 2. Drive motor 08 can drive either directly or via a gear 09, pinion gear, or toothed belt one of the two printing group cylinders 03, 07, and from there the other one of the two printing group cylinders, or can drive both printing group cylinders 03, 07 in parallel. With this embodiment, a drive mechanism without gear wheels favors an oil-free operation, for example. A closed, for example encapsulated, gear for only the two printing cylinders 03, 07 assigned to each other facilitates the saving or the elimination of an oil chamber between frame walls.

In an advantageous embodiment, because it is still more flexible and is particularly suited for oil-free operation, each one of the printing group cylinders 03, 07 has its own drive motor 08, as seen in FIG. 1, which again drives the respective printing group cylinder 03, 07 axially, for example via a gear, shown by way of example in the upper printing group, or laterally offset via a gear, pinion gear, or toothed belt. In an advantageous embodiment, driving of the cylinder 03, 07, or its journal, is performed substantially coaxially from the drive motor 08, or from the output of the gear 09, or if required, also via a coupling which compensates for angles or offsets. Thus, a cylinder drive wheel with a pinion, as well as any requirement for a lubricant are omitted. In this case, the gear 09 is advantageously embodied as an epicyclic gear which gears or reduces the rpm of the drive motor 08 down. For example, the gear 09 may be embodied as a planetary gear 09, for example embodied as an ancillary gear.

As schematically represented in FIG. 1 in connection with the two upper printing groups 01, each of the inking units 02 has a plurality of rollers 11, 12, 13, 14, of which the applicator rollers 11, the transfer roller 13, and the distribution cylinders 12 and 14 are specifically identified in the drawing figures. The transport of the ink from a supply system or a reservoir to the distribution cylinder 14 can be performed in various ways.

Figure 3:
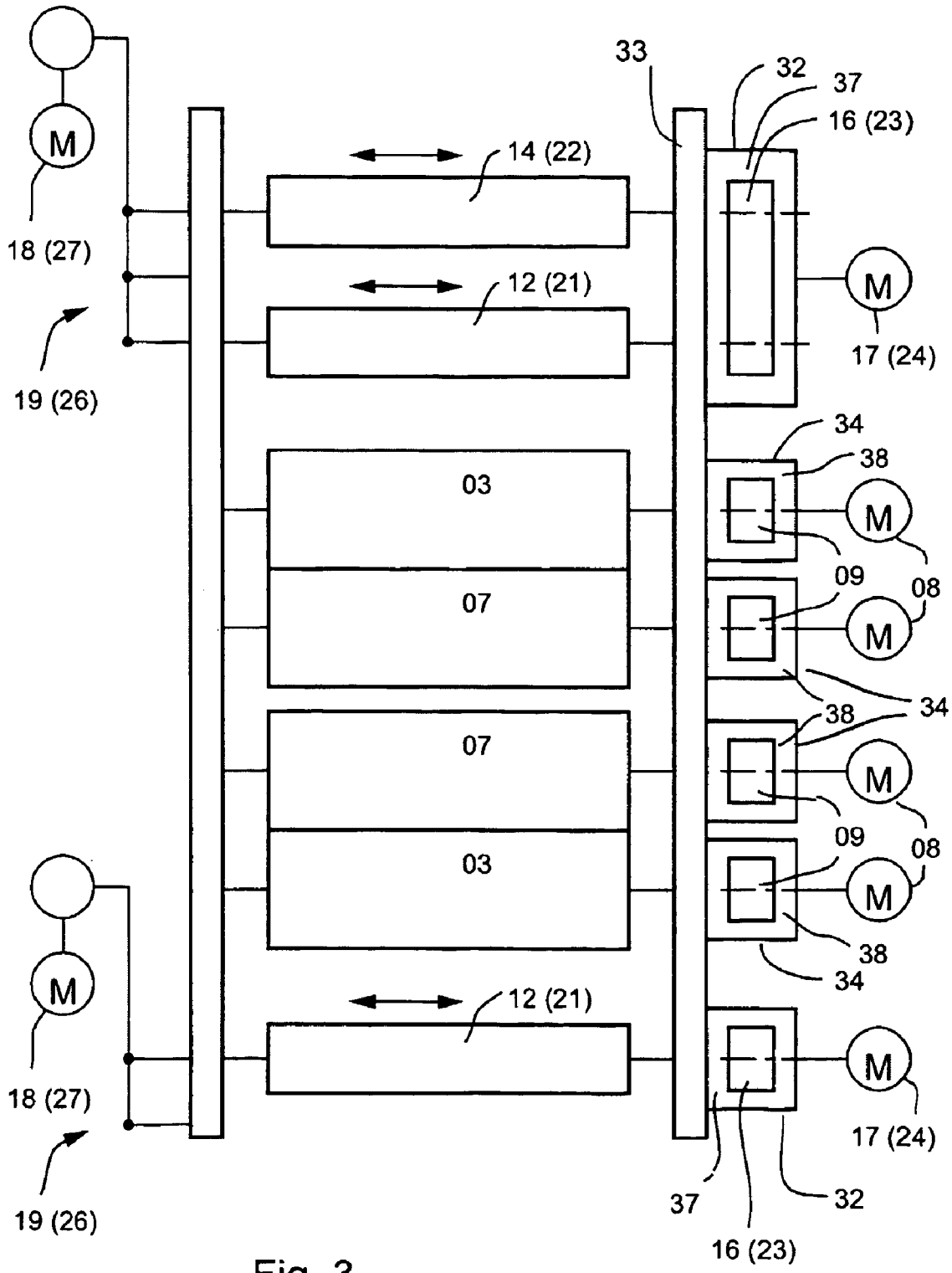

Rotating bodies 12, 14 represent the two distribution cylinders 12, 14 of the inking unit 02, which rotating bodies 12, 14 are seated to be rotatable around their longitudinal axes, but are also movable in the axial direction, in relation to the cooperating rollers. In the preferred embodiment shown in FIG. 1, the distribution cylinders 12, 14 are rotatorily driven, preferably together, via a gear 16, by a common drive motor 17, which drive motor 17 is independent of the drive mechanism of the printing group cylinders 03, 07. If required, each of the distribution cylinders 12, 14 can also be individually rotatorily driven via a gear 16 by its own drive motor 17. Cylinders 12, 14 are also moved, preferably together, in the axial direction of the distribution cylinders 12, 14 by the use of a further drive means 18, for example by an axial drive motor 18, shown in FIG. 3, which axial drive motor 18 is independent of the drive mechanism of the printing group cylinders 03, 07, via a further gear 19, for example a crank drive 19, so that they perform a back-and-forth movement over a stroke of an amplitude A which amplitude A can preferably be adjusted. If several distribution cylinders 12, 14 can be driven together axially by use of a gear 19, the phase and/or stroke of the back-and-forth movement of each individual, mutually axially driven distribution cylinder 12, 14 can be adjusted independently of each other. The axial drive mechanism are not represented in FIG. 1, but are shown in FIG. 3. Reference symbols are only assigned to the "right half" of the printing unit shown in FIG. 1, since the left side corresponds, in a mirror-reversed way, to the right side.

In place of, or in addition to the distribution cylinders 12, 14, other rollers 11, 13 of the inking unit 02 can also be rotatorily driven individually or mutually via a gear 16.

In the first preferred embodiment of the upper printing groups 01 in accordance with the present invention, the dampening unit 06 also has several rollers 20, 21, 22, 25, which provide at least an application roller 20, two distribution cylinders 21, 22 and a transfer roller 25. Here, too, the distribution cylinders 21, 22, for example, are rotatorily movable via a gear 23 by the use of a common drive motor 24 and, are also movable in the axial direction, via a gear 26, as seen in FIG. 3, by the use of a common drive motor 27, for example by a drive motor 27. In place of, or in addition to the distribution cylinders 21, 22, other rollers 20, 25 of the dampening unit 06 can also be rotatorily driven individually or mutually via a gear 26.

A preferred embodiment for use with the configuration of the printing unit as a satellite printing unit, is represented in FIG. 2. The transfer cylinder 07 of the printing group 01, together with a rotating body 28 embodied as a satellite cylinder 28, constitutes a printing position. The satellite cylinder 28 is again individually rotatorily driven by its own drive motor 29 via a gear 31. In an embodiment, which is not specifically represented, the satellite printing unit may have two such satellite cylinders 28, each of which can be individually driven, but which can also be mutually driven by a common drive motor 29 via the gear 31. The axial drive mechanisms are again not represented in FIG. 2.

The drive mechanism of the printing group cylinders 03, 07 of each printing group 01 in pairs, via a pinion gear as a part of the gear 09 driving a drive wheel of the forme cylinder 03 is also represented by way of example in FIG. 2. Driving of the printing group cylinders 03, 07 can then take place from the drive wheel of the forme cylinder 03 to the drive wheel of the transfer cylinder 07. This can take place by a gear wheel connection as a part of the gear 09, which connection may be encapsulated, for example, or via belts. Driving can also take place initially to the transfer cylinder 07 and from there to the forme cylinder 03, or also coaxially to one of the cylinders 03, 07.

The embodiment of the present invention, as described in connection with FIGS. 1 and 2, by reference to the upper printing groups 01, can also be applied to the lower printing groups 01, and vice versa. However, by way of example the inking units 02 and dampening units 06 have been represented in FIGS. 1 and 2 only with one distribution cylinder 12, 21. In an advantageous embodiment, these cylinders are each rotatorily driven by the drive motor 17, 24 via the gear 16, 23, and in the axial direction by the drive motor 18, 27, as seen in FIG. 3, via the gear 19, 26, respectively.

Figure 4:
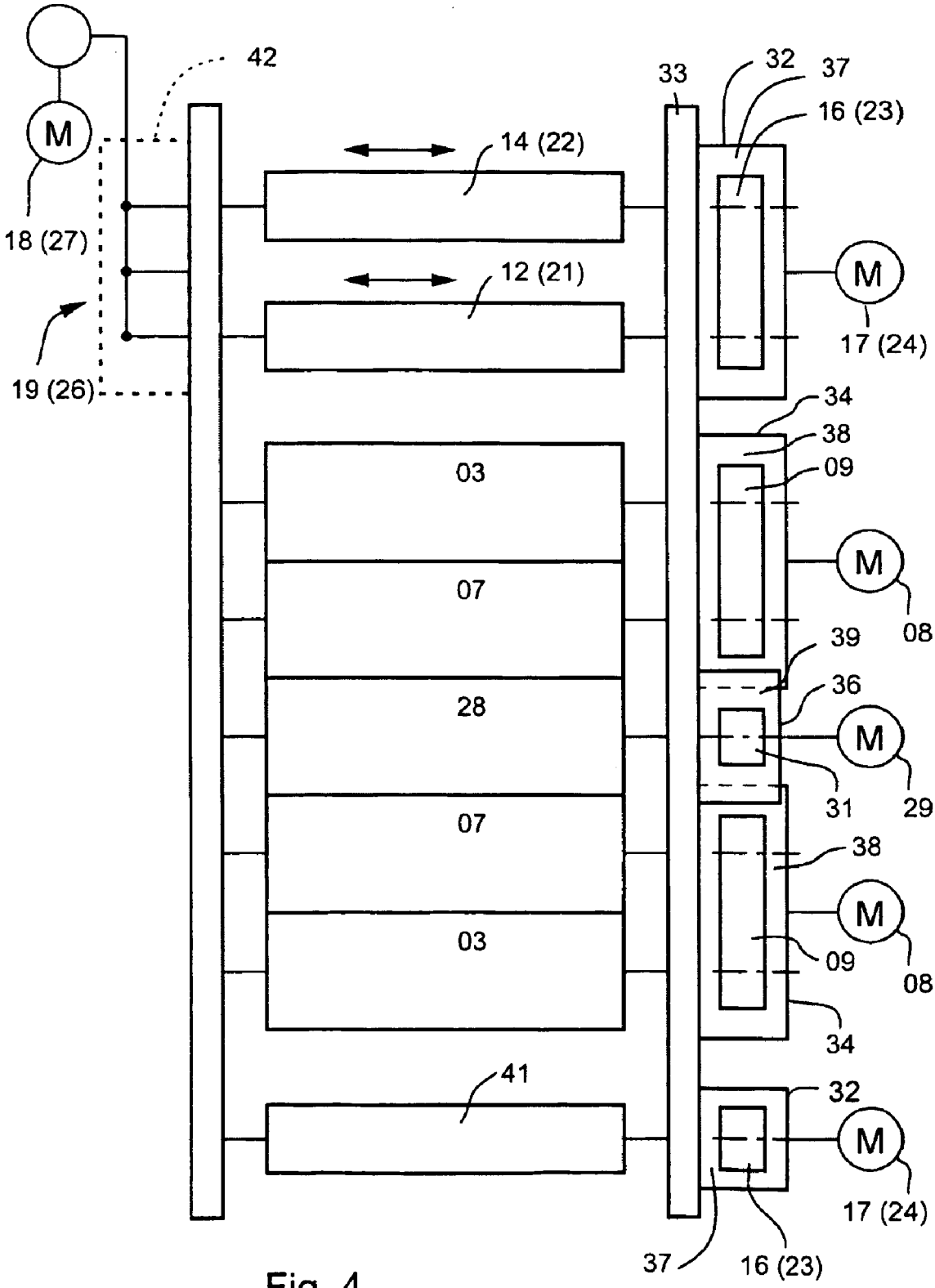

The individual or the paired drive mechanisms from FIGS. 1 and 2, or hereafter from FIGS. 3 and 4 for "rubber-against-rubber" printing units and for satellite printing units, can be alternatingly applied to each other. A configuration of the satellite printing unit from FIGS. 2 or 4 is particularly advantageous, wherein all of the printing cylinders 03, 07 of the cylinder pairs, as well as the counter-pressure cylinder 28, have their own drive motor 08, 29, which drives the cylinder 03, 07 via a gear 09, 31, respectively and the distribution cylinders 12, 14 are, for example, driven by a common drive motor 17 via a gear 16 which is closed toward the exterior.

FIGS. 3 and 4 represent the embodiments shown in FIGS. 1 and 2 schematically in a vertical section. The representation of the rollers 11, 13 has been omitted in FIGS. 3 and 4. Also, the dampening units 06, if provided are not shown in this representation. However, what applies to the inking units 02, should also be applied to the dampening units 06. For this reason, the reference symbols for the distribution cylinders 21, 22, for the gears 23, 26, as well as the drive motors 24, 27, respectively have been placed in parentheses next to the reference symbols of the inking units 02.

In FIG. 3 two rollers 12, 14, shown here as the distribution cylinders 12, 14 of the upper inking unit 02, have a common drive motor 17. In this embodiment, the gear 16 which may be, for example, a wheel train 16 or a traction mechanism gear 16, is configured to be closed against its surroundings. For this purpose, the gear 16, which is only assigned to the two distribution cylinders 12, 14, is arranged in a housing 32 that is assigned to only the two distribution cylinders 12, 14.

The housing 32 can have an open side, for example, which housing 32, together with a lateral frame 33, constitutes a closed encapsulated chamber. The lower inking unit 02 which, in the example has one driven roller selected from its rollers 11, 12, 13, 14, for example a distribution cylinder 12, also has a housing 32 assigned only to this roller selected from the rollers 11, 12, 13, 14, for example the one distribution cylinder 12 and which housing 32 forms, together with the lateral frame 33, an encapsulated chamber 37 receiving the gear 16.

The drive motor 18, as well as the gear 19 for the axial movement of the distribution cylinders 12, 14 are arranged on another side of the press, for example, from the drive motors 8, 17, and 24.

All of the printing group cylinders 03, 07 have their own drive motors 08 and, in this first preferred embodiment, each also has a housing 34 containing only the respective gear 09.

In contrast to FIG. 3, in the preferred embodiment in accordance with FIG. 4 the printing unit has the satellite cylinder, or cylinders 28, which is or are driven by the individual, or by a common drive motor 29 via the gear 31.

In this embodiment, too, a housing or housings 36 is or are assigned to the individual drive motor 29 or to the common drive motor 29, which receives the gear 31 and encapsulates it toward the exterior.

In the depicted example, the two printing group forme and transfer cylinders 03, 07, respectively have a common drive motor 08 and a housing 34 receiving the respective gear 09 for each pair. As explained above, however, the single drive mechanism from FIG. 3 can also be applied to the printing group cylinders 03, 07 of FIG. 4.

As seen in FIG. 4, a preferred embodiment for the drive mechanism of a printing group was represented in the lower area, which printing group has a roller 41, which is rotatorily driven by the drive motor 17 via the encapsulated gear 16 and which roller 41 is provided with small cups on its surface, for example, roller 41 may be a screen or an anilox roller 41. The screen roller or anilox roller 41 transfers the ink, for example, to one or two application rollers 11, which are not specifically represented. It does not perform an axial back-and-forth movement.

The gears 09, 16, 23, 31 are embodied as individually encapsulated gears 09, 16, 23, 31, which are assigned to several cylinders 03, 07, 28, or to several rollers 12, 14, 21, 22 of the same structural component, or are each assigned to a single cylinder 03, 07, 28, or to an individual roller 12, 14, 21, 22, 41. Here, for example, the pair of printing group cylinders 03, 07, the rollers 11, 12, 13, 14, 22, 41, in particular the distribution cylinders 12, 14 of the inking unit 02, and the rollers 20, 21, 22, 25, in particular the distribution cylinders 21, 22 of the dampening unit 06, should be understood to be structural components.

By the provision of the respective housing 32, 34, 36, the gears 09, 16, 23, 31 are each arranged in a closed, spatially greatly restricted chamber 37, 38, 39, in which lubricant, such as, for example, oil, can be present without being able to escape from the chamber 37, 38, 39, and without the necessity of a multi-walled lateral frame.

In connection with a single drive mechanism of a roller 11, 12, 13, 14, 21, 22, 25, 41; of a distribution cylinder 12, 14, 21, 22; of a printing group cylinder 03, 07; or of a satellite cylinder 28, the arrangement of a drive motor 08, 17, 24, 29 with a gear 09, 16, 23, 31 placed on it, or flanged to the drive motor and being individually encapsulated, such as an encapsulated epicyclic gear or a reduction gear, for example, is especially advantageous.

In an advantageous embodiment, all of the gears 09, 16, 23, 31, or at least the gears of the inking units 02 and/or of the dampening units 06, are configured as reduction gears 16, 23. The gears 16, 23 for use in driving two distribution cylinders 12, 14; or 21, 22, in pairs, are preferably embodied in such a way that the two distribution cylinders 12, 14; or 21, 22 rotate in the same direction. If gears 16, 23 are each embodied as a gear wheel train, an intermediate wheel is arranged between drive wheels of the two distribution cylinders 12, 14, 21, 22. One of the drive wheels, or the intermediate wheel, can then be driven by operation of the drive motor 17, 24. The gears 09, 16, 23, 31 can also have a traction mechanism gear, for example a belt drive, and in particular a toothed belt drive or, in an advantageous embodiment of one or several of the gears 09, 16, 23, 31, they can be configured as traction mechanism drives with traction assemblies, in particular with toothed belts. A gear 09, 16, 23, 31, for example, for driving one or several distribution cylinders 12, 14, 21, 22, can be embodied as a belt drive with toothed belts, for example, as will be described subsequently.

In an advantageous embodiment of the present invention, the gear 16, 23 of the back-and-forth moving distribution cylinders 12, 14; or 21, 22 is embodied in such a way that the rotatory drive motor 17, 24 can be arranged fixed in place on the frame. This is possible, for example, through the use of spur toothing, or, in the situation of a previously mentioned belt drive, with an axially movable drive wheel or with an extra wide drive wheel, on which the belt, for example a toothed belt, can run helically during the movement of the distribution cylinders 12, 14; or 21, 22.

In an advantageous embodiment of the present invention, the axial drive mechanism, or its gear 19, 26 used for transmitting or for converting its axial movement to the distribution cylinder 12, 14, 21, 22, is not located in a lubricant or oil chamber. If lubricant is required, the gear 19, 26 is preferably embodied as a gear 19, 26 which is closed to the outside and is encapsulated, which encapsulation or housing is only assigned to the drive motor 18, 27 driving this gear 19, 26. By way of example, a suitable housing 42 is represented in dashed lines in FIG. 4 for this purpose. A gear 19, 26, which axially drives one or several distribution cylinders 12, 14; or 21, 22, can have a traction mechanism gear, in particular a toothed belt, or can be embodied as such.

In the case of axial driving of the distribution cylinders by the use of a drive motor 18, 27, the gear 19, 26, which converts the rotatory movement of motor 18, 27 to an axial stroke, is arranged outside of a barrel of the distribution cylinder 12, 14, 21, 22, but not in an extended common oil or lubricant chamber together with gears of other structural components, such as an adjoining inking or dampening unit 02, 06, or a printing group cylinder 03, 07, for example. The drive motor 18, 27 itself, however, can also have its own encapsulated, not specifically identified gear, that is represented merely as a circle in FIG. 3 or 4, and which may be, for example, a reduction gear and/or an angular gear. By way of example, the converting and/or reducing gear 19, 26 is configured in this embodiment as a crank drive with an eccentric, as a limit stop, circulating in a curve-shaped groove, or in other ways. In this case, individual gears, and, if required, individually encapsulated gears, which convert a rotatory movement into an axial movement and which are mutually driven by a traction mechanism or by a shaft, as represented, by way of example, in FIG. 20, can be assigned to all of the mutually driven distribution cylinders 12, 14, 21, 22.

In a further development, axial driving of the rollers or cylinders is not provided by the drive assemblies 18, 27, which are embodied as drive motor 18, 27, but instead is accomplished by a piston, which piston can be acted upon by a pressure medium, or by a magnetic force, for example. In this case, a coupling, for example, represents the transmitting or the converting gear 19, 26. These driving variations are advantageous, for example, together with individually encapsulated rotatory drive mechanism.

The variations of the individual or of the paired rotatory drive mechanisms represented in the preferred embodiments, and the assigned gears 09, 16, 23 31, as well as the individual or paired axial drive mechanisms and their assigned gears 19, 26, are each shown, by way of example, in the printing groups 01 of FIGS. 1 to 4 arranged "at the top" or "the bottom" for the purpose of an efficient representation. In particular, a printing unit can have four printing groups 01, all of which printing groups 01 have an inking unit 02, each with two distribution cylinders 12, 14, and a dampening unit 06, each with respectively one distribution cylinder 21. Instead of the driven distribution cylinders 12, 14, all of the inking units 02 can also have a driven screen roller 41. Also, for the combination of the drive mechanisms of the cylinders 03, 07, 28 with those of the inking or dampening units 02, 06, the embodiments in FIGS. 1 and 3 should be applied to the embodiments in FIGS. 2 and 4, and vice versa. Thus, all cylinders 03, 07, 28, and all rollers to be driven, 11, 12, 13, 14, 20, 21, 22, 25, 41 can have, depending on the specific embodiment, their own rotatory drive motor 08, 17, 24, 29 via an encapsulated gear 09, 16, 23 31, respectively. The several variations represented and mentioned above of the axial drive mechanism are to be applied alternatingly to the various printing groups 01 in addition.

Thus, for example, the printing unit, as seen in FIG. 1, can have four printing groups 01, each one of whose printing group cylinders 03, 07 and, if provided, the satellite cylinder 28, are rotatorily driven by their own drive motors 08, 29 via their own encapsulated gear 09, 31, while at least the inking unit 02, and possibly also the dampening unit 06 has two distribution cylinders 12, 14; or 21, 22, which can be driven in pairs rotatorily by a common drive mechanism 17, 24 via an encapsulated gear 16, 23, and can be driven in pairs axially by a common drive mechanism 18, 27 via a gear 19, 26. In a modification, all cylinders 03, 07, 28, as well as all distribution cylinders 12, 14, of the inking unit 02, and possibly all distribution cylinders 21, 22 of the dampening unit 06, can each be rotatorily driven by their own drive motor 08, 17, 24, 29 via their own closed gear 09, 16, 23, 31. Coaxial driving of the cylinders 03, 07, 28, and possibly also of the distribution cylinders 12, 14; and 21, 22 from the gear 09, 16, 23, 31 is advantageous.

One embodiment of a printing group 01 is preferably selected, in a printing group, for the configuration of all of the printing groups 01 constituting the printing unit. The selection of the specific embodiment of the printing groups 01 in the printing unit depends on the degree of desired flexibility, on the cost and on the selection of the inking unit 02 or dampening unit 06, such as with one or two distribution cylinders 12, 14, 21, 22, or as a short inking unit with a screen roller 41, etc.

In an advantageous manner, the drive motors 08, 17, 24, 20 disclosed for accomplishing the rotatory driving, are embodied in such a way that they are also used for driving their respective cylinders and rollers during production. In this way, it is possible to operate the driven units during set-up or during maintenance operations, as well as during production, by using these drive motors 08, 17, 24, 29 and without a requirement for any auxiliary drive mechanisms. At least the drive motors 08, 29 of the printing group cylinders 03, 07, 28 are preferably embodied as drive motors 08, 29 whose angular position is regulated. If the drive motors 17, 24 of the inking or dampening units 02, 06 are not also regulated in respect to their angular position, they are advantageously embodied so that they can be regulated with respect to their number of revolutions. The same applies to the drive motors 18, 27 utilized for accomplishing axial movement.

In the situation in which cylinders 03, 07, or rollers 11, 12, 13, 14, 20, 21, 22, 25 for rotatory driving are coaxially driven, it is of advantage for the arrangement of reduction gears 09, 16, 23, 31 to be embodied as planetary gears 09, 16, 23, 31.

Detailed preferred embodiments of the drive mechanism for the printing groups 01, and in particular for the inking and dampening units 02, 06, are provided in FIGS. 5 to 21. The above remarks regarding the driving of the printing group cylinders 03, 07, 28, as well as the gears 09, 16, 23, 31, and the encapsulations should be applied, as appropriate. A dampening unit 06 can also be driven as explained above, while the inking unit 02 is embodied as explained in what follows, or vice versa.

In an advantageous embodiment at least the pairs of the printing group cylinders 03, 07 for each printing unit 01, represented, by way of example, in the lower double printing group, have a drive motor 08 which is independent of any of the other printing groups 01. Drive motor 08 can be configured for driving in the way previously described in connection with FIG. 1. In a more flexible further development, which is suitable for an oil-free drive mechanism, it is possible for each one of the printing cylinders 03, 07 to have its own drive motor 08, also as described in connection with FIG. 1.

As shown in FIG. 1, and as discussed in connection therewith, each of the inking units 02 in FIG. 5 has the application rollers 11, the transfer roller 13 and the distribution cylinders 12 and 14.

Figure 5:
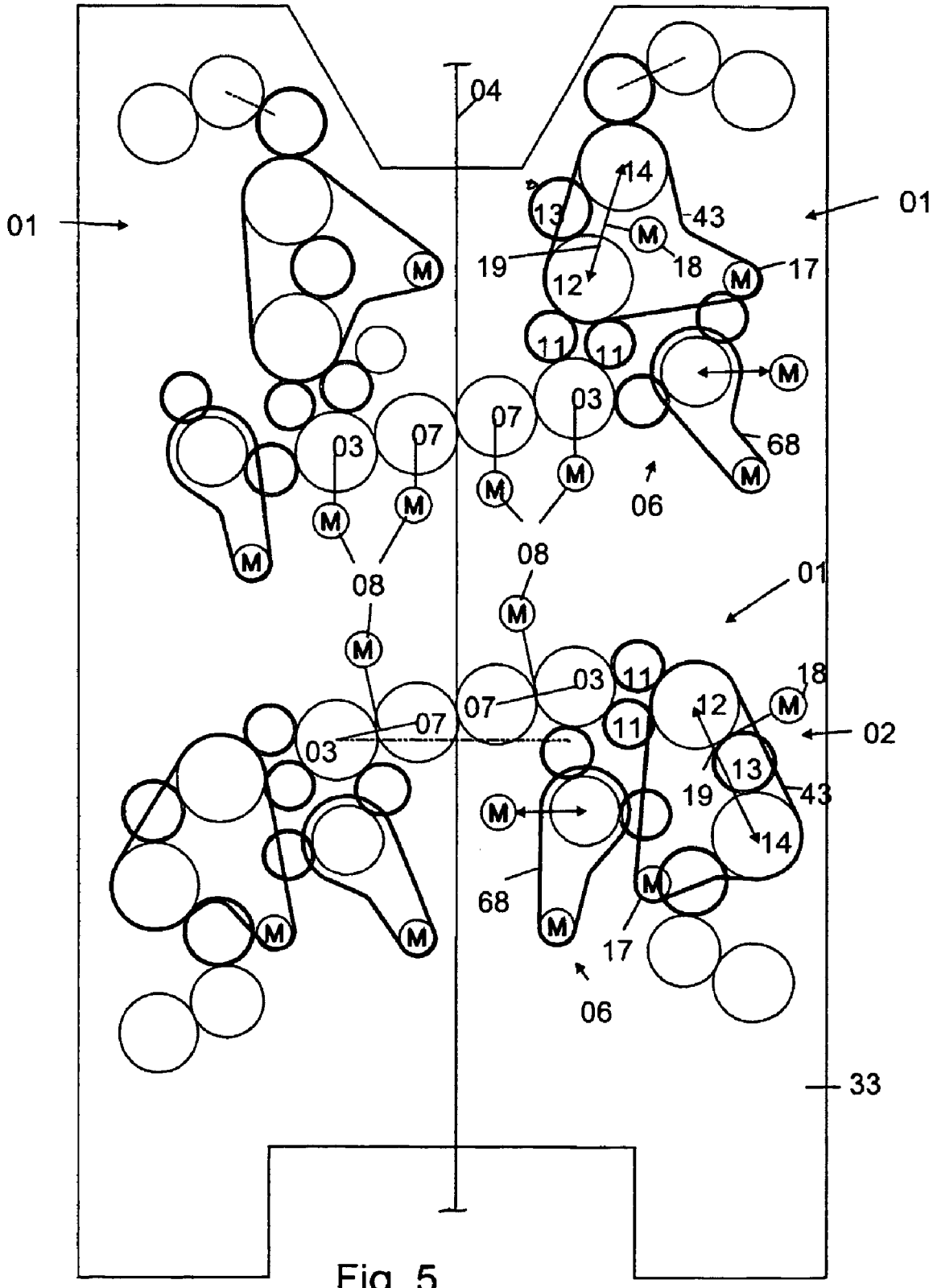

The two distribution cylinders 12, 14 of the inking unit 02 of FIG. 5 represent rotating bodies 12, 14, which are seated so as to be rotatable around their longitudinal axis, and to also be movable in the axial direction in respect to a lateral frame 33. They are rotatorily driven by a gear 16, which is embodied as a traction mechanism gear 16, via a traction mechanism 43, and are preferably driven together by use of the common drive motor 17, which drive motor 17 is independent of the drive mechanism of the printing group cylinders. The two distribution cylinders 12, 14 can possibly also each be driven individually via the traction mechanism 43. They are moved axially, preferably together, by drive mechanisms 18, which drive mechanisms 18 are independent of the drive mechanism of the printing group cylinders, for example by the drive motor 18, via the gear 19, for example via a crank drive 19, in the axial direction of the distribution cylinders 12, 14. The two distribution cylinders 12, 14 thus perform a back-and-forth movement through a preferably adjustable stroke length or a lift of an amplitude A.

Figure 6:
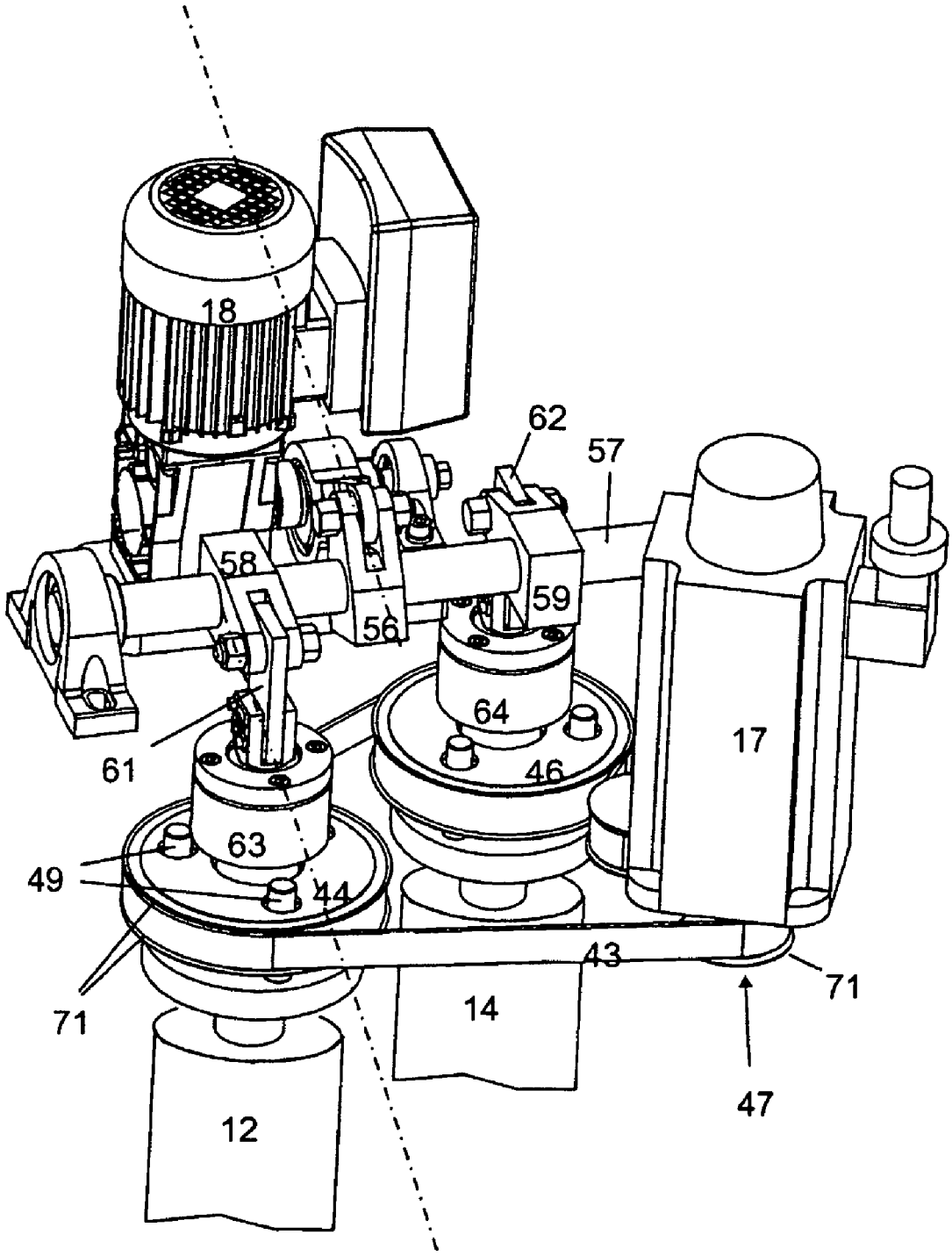
Figure 7:
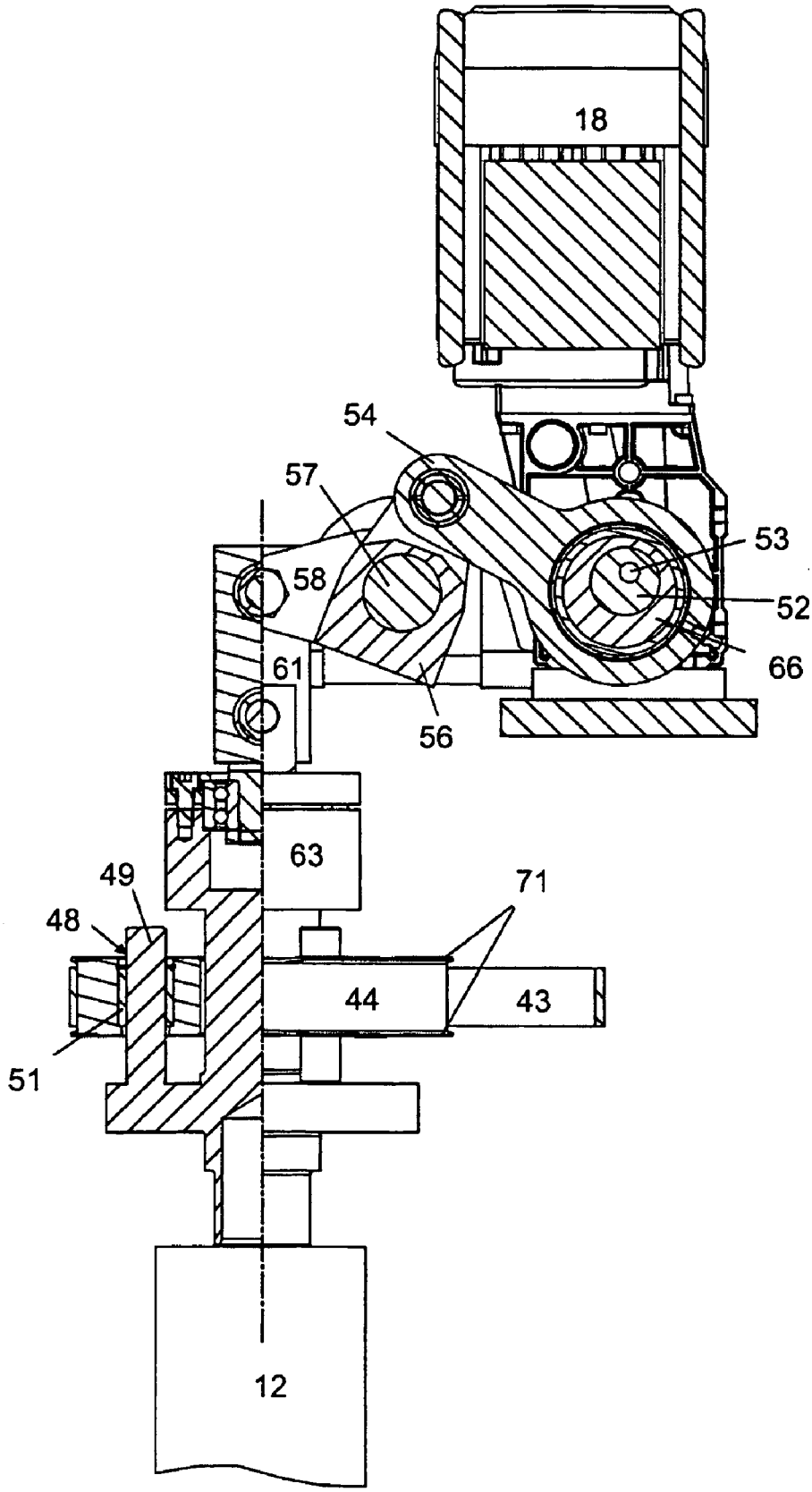

The distribution cylinders 12, 14, as seen in FIGS. 6 and 7, are each connected at their fronts, in a torsion-proof and coaxial manner with a drive wheel 44, 46, for example a pulley 44, 46, which acts together with the traction mechanism 43, to rotatorily drive the distribution cylinders 12, 14. The traction mechanism 43, which is embodied, for example, as a toothed belt 43 or as a V-belt, is driven via a drive wheel 47 that is connected with the drive motor 17, as seen in FIG. 6. In the preferred embodiment, the traction mechanism or belt 43 rotates around the drive mechanisms of both distribution cylinders 12, 14 in the same direction of rotation and, in this way, forms a closed, non-crossing loop.

In a first preferred embodiment for the drive mechanism of the inking unit 02, as seen in FIGS. 6 and 7, although each pulley 44, 46 is connected in the circumferential direction of the respective distribution cylinder 12, 14 and at least in one direction of rotation as an engagement connection and coaxially with it, in the axial direction the pulley 44, 46 is arranged to be movable relative to the distribution cylinder 12, 14. In the depicted configuration, the engagement connection has been provided in such a way that the pulley 44, 46 has at least one opening 48, for example at least one bore 48, as seen in FIG. 7, in an area outside of its center and with bore 48 extending in the axial direction of the distribution cylinder 12, 14. Bore 48 works together with a bolt 49, which is connected, fixed against relative rotation, with the distribution cylinder 12, 14. In a reversed or other way, the engagement connection can also have limit stops 48, 49 on the distribution cylinder 12, 14 and on the drive wheel or pulley 44, 46, which are effective in the circumferential direction and which prevent twisting, at least in one direction of rotation, but which permit an axial relative movement. To reduce frictional forces, in particular because the limit stops 48, 49 transmit the driving forces, a friction-reducing bearing 51, shown in FIG. 7, in particular a linear bearing 51, which is embodied as a needle bearing 51, is arranged between the effective surfaces.

The drive mechanism configured in this way makes possible the mutual rotatory driving of the distribution cylinders 12, 14 via the common traction mechanism 43, together with the simultaneous back-and-forth movement of the two distribution cylinders 12, 14. Thus, the traction mechanism 43 need not follow the back-and-forth movement of the distribution cylinders 12, 14 which stationary configuration of the traction mechanism 43 otherwise would not be possible, particularly in the case of two distribution cylinders 12, 14 moving back-and-forth in opposite directions, or would only be possible with considerable losses in accuracy and with a substantial reduction of the service life of the components involved.

Driving for accomplishing the axial movement, from the drive motor 18 is performed, as seen in FIG. 7, in such a way that an eccentric device 52, or an eccentric bushing 52, which is positioned on a shaft 53 driven by the drive motor 18, for example via a conical wheel gear, acts as a crank, which crank transmits its eccentric movement, in the form of an oscillating linear movement, to a first coupler 54 including the eccentric bushing 52. The free end of the first coupling 54 is hingedly connected with a lever arm 56, which, in turn, is arranged, fixed against relative rotation, on a shaft 57, which can be pivoted around a shaft fixed in place on the frame. A number of lever arms 58, 59, and corresponding to the number of the distribution cylinders 12, 14 to be moved, are connected, fixed against relative rotation, with this shaft 57, and they are hingedly connected with a second coupler 61, 62. The free end of the second coupler 61, 62 is connected, via a coupling 63, 64, with the respective distribution cylinder 12, 14 in such a way that a relative movement in the circumferential direction of the distribution cylinder 12, 14 is possible, but a relative movement of the coupler 61, 62 and the distribution cylinder 12, 14 in the axial direction is prevented.

In the embodiment selected, the phases of the movements of the two distribution cylinders 12, 14 in relation to each other, as well as the amplitude A, of the axial lift or displacement can be adjusted in a simple manner, but are nevertheless rugged and reproducible. A first adjustment possibility allows the arrangement of a second eccentric device 66 between the coupler 54 and the shaft 53, as may be seen in FIG. 9, by use of which the stroke can be set by relative twisting and by the subsequent fixation in place of the two eccentric devices 52, 66. The amplitude of the stroke A can be selected by the length of the lever arms 58, 59 individually and relative to each other. The phase of the movements, in respect to each other, can be determined by the relative length of the lever arms 58, 59 with respect to each other in the circumferential direction of the shaft 57.

Thus, a simple and rugged drive mechanism, along with the greatest possible degrees of freedom, is provided. This permits an individual rotating speed independently of the printing group cylinders 03, 07, and also permits an independent stroke frequency and amplitude A.

Figure 8:
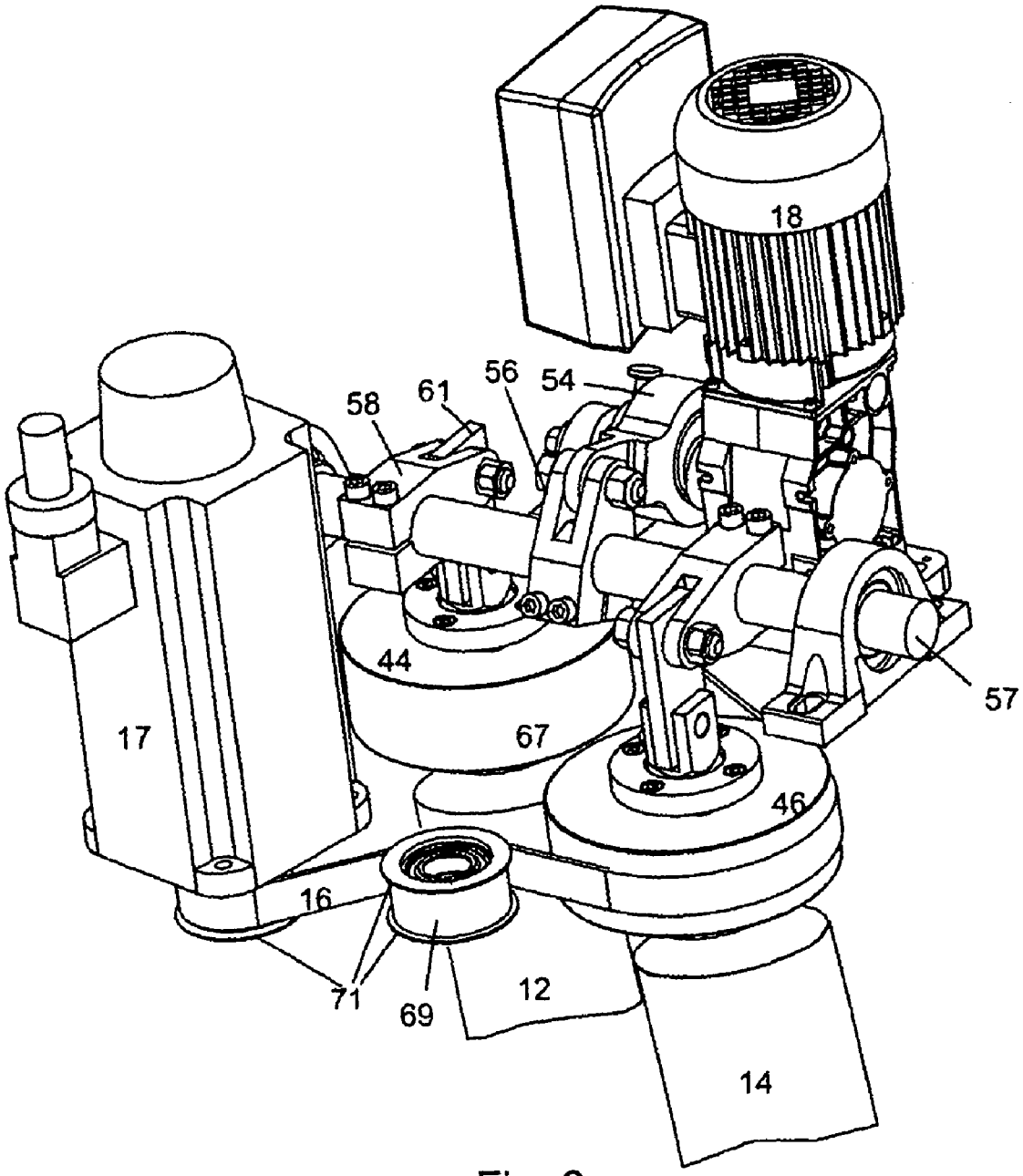
Figure 9:
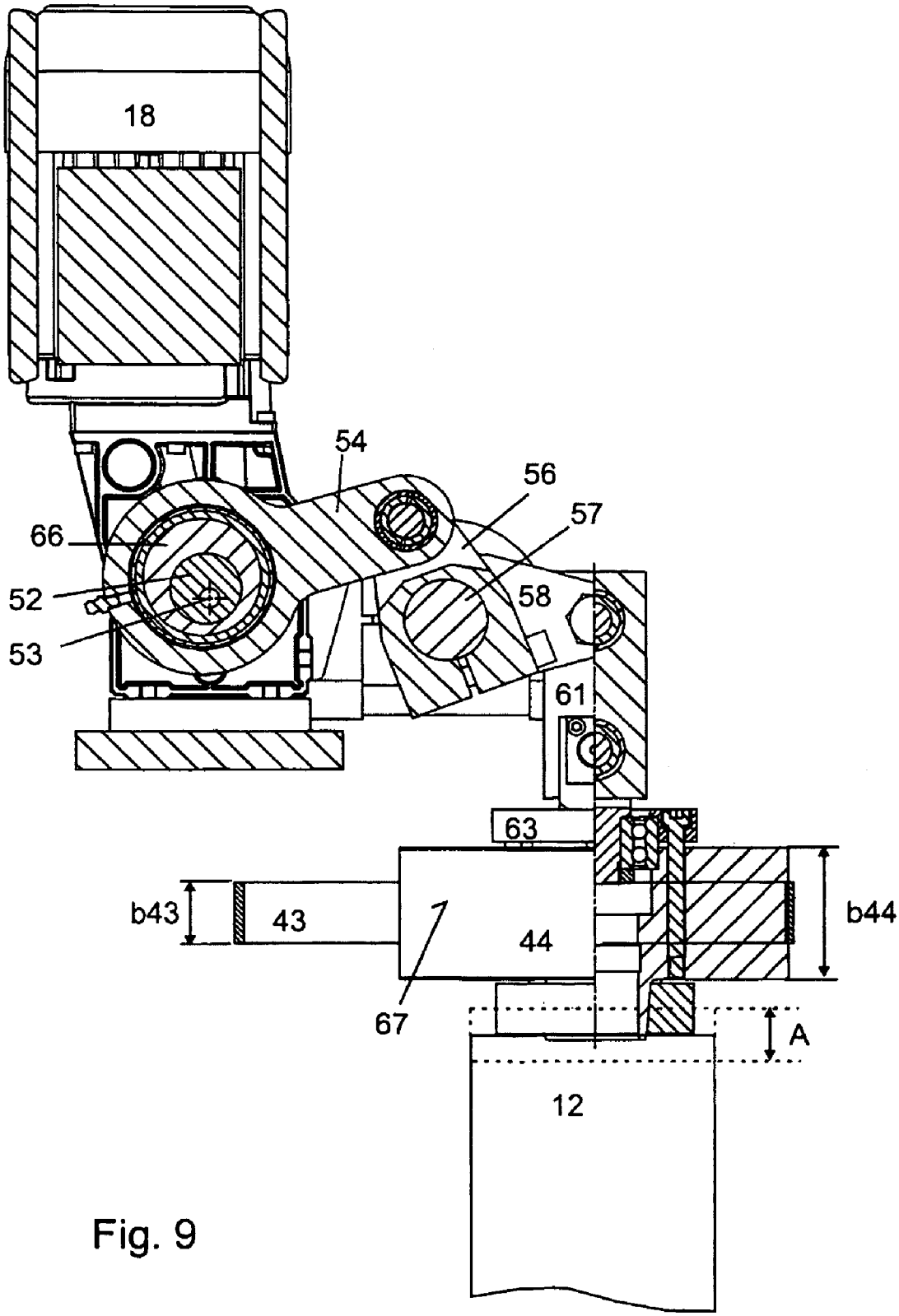

In a second preferred embodiment of the drive mechanism of the inking unit 02, as seen in FIGS. 8 and 9, the drive wheel 44, 46, which is embodied as a pulley 44, 46, is connected with the respective distribution cylinder 12, 14, fixed against relative rotation, and in the axial direction of the latter. However, the drive wheel 44, 46 has a width b44, b66 of its effective area 67 cooperating with the traction mechanism 43, which width corresponds at least to the sum of a width b43 of the traction mechanism and a maximum amplitude A of an axial stroke of the distribution cylinder 12, 14. In FIG. 9, the amplitude A is represented by dashed lines for an end of the friction cylinders 12, 14 in the case where the depicted, instantaneous position corresponds to a center position. The various positions of the drive wheels 44, 46, the coupling 61, and the like could also be represented by dashed lines. This depiction was omitted for reasons of clarity.

The drive mechanism of the distribution cylinders 12, 14 corresponds, in principle, to the drive mechanism represented by the first example and will not be further described or shown here.

If the distribution cylinder 12, 14 performs a back-and-forth movement, while being rotatorily driven by the drive motor 17, the traction mechanism 43 generally maintains its position relative to a lateral frame, but wanders from one side to the other, relative to the drive wheel 44, 46, in the direction of the axis of rotation of the latter. For example, traction mechanism 43 describes a helical line on the effective area 67 of the drive wheel, which is "squashed" in respect to a sine shape and which alternatingly extends downward and upward.

In the case of a wet offset printing method, the advantages gained by utilization of the drive mechanisms of the inking unit 02 represented in FIGS. 5 to 8, possibly in connection with the above explained drive mechanism of the cylinder pair 03, 07, can also be applied, to a large extent, to the drive mechanism of the dampening unit 06. In particular, with the presence of a dampening unit 06, further advantages, with respect to the flexibility in the interplay between the inking and dampening units 02, 06, result. This is particularly true if the axially movable distribution cylinder 43, or of several such distribution cylinders 43, embodied as a group as in the previous examples, has the drive motor 44, which drive motor 44 is independent of the drive mechanisms of the printing group cylinders 03, 07, for rotatory driving, and also has the drive source 27, for example the drive motor 27, which is independent of the drive mechanism of the printing group cylinders 03, 07, for generating the lateral movement. In view of the optimal transmission, on the one hand and, on the other hand, in view of the possibility of an oil-free drive mechanism and/or the simultaneous driving of several back-and-forth-moving distribution cylinders 21, 22, driving is here also provided to a considerable advantage via a traction mechanism 68, for example via a toothed belt 68 or a V-belt.

Since the discussion regarding the rotatory drive mechanism, as well as regarding the axial movement, partially overlap with the examples shown for the inking unit 02, only the differences will be discussed in what follows. Regarding the matters corresponding to those for the inking unit 02, reference is made to what was said above.

Figure 10:
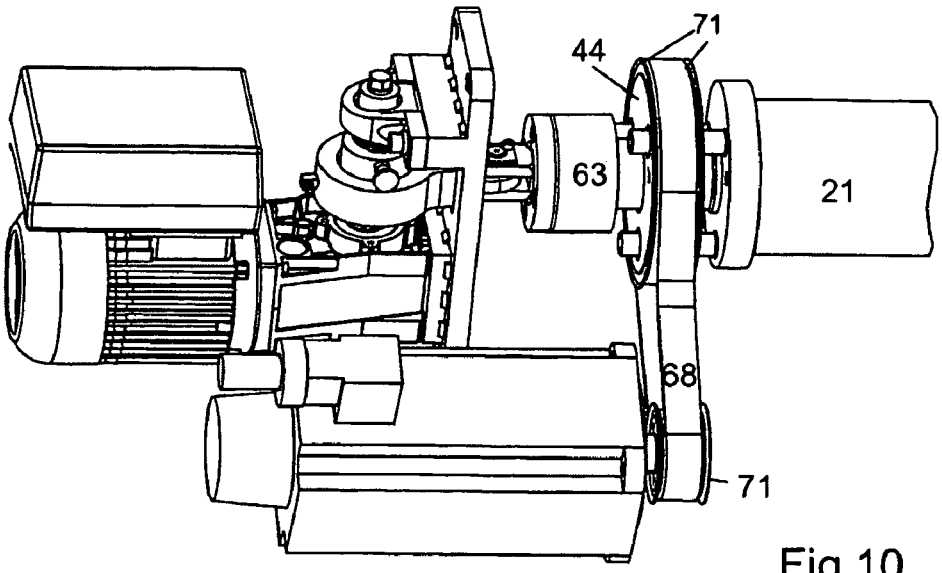
Figure 11:
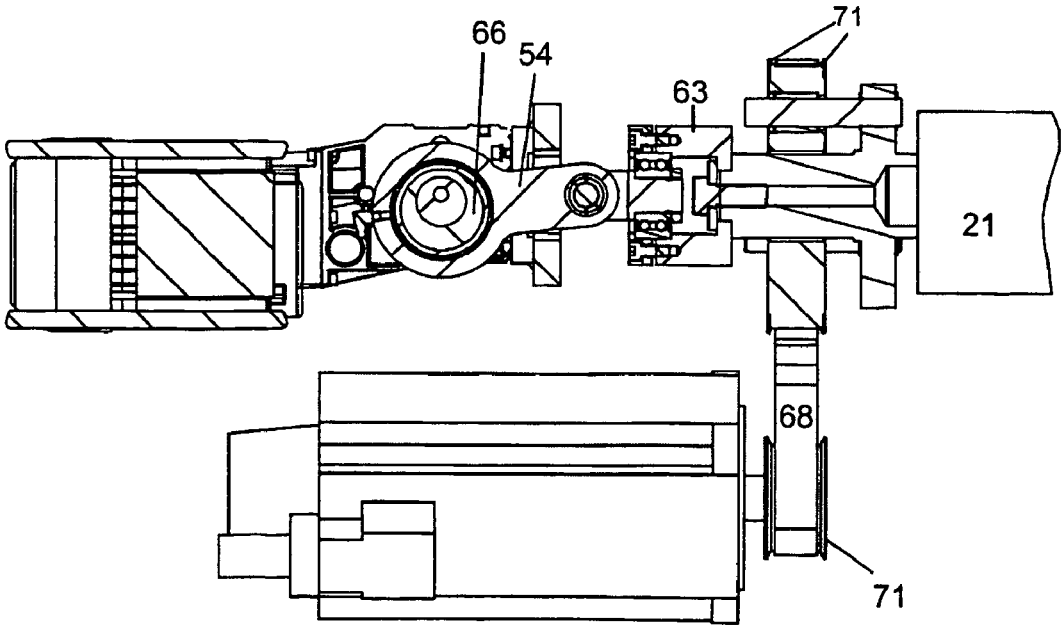

In the first preferred embodiment of the drive mechanism for the dampening unit 06, as seen in FIGS. 10 and 11, the rotatory drive mechanism of the distribution cylinder 21, 22 via the traction mechanism 68 corresponds, to a large extent, to that described in accordance with the preferred embodiment in accordance with FIG. 6. The drive wheel 44, which uses the same reference numeral, since it is embodied in the same way, and the distribution cylinder 21, 22 are also movable, in this embodiment, in the axial direction in relation to each other, but are rigidly connected with each other in the circumferential direction. In the present preferred embodiment, the dampening unit 06 has only one distribution cylinder 21, so that the traction mechanism 68, which is embodied as a toothed belt 68, only drives the drive wheel 44 of the single distribution cylinder 21. If more than the one distribution cylinder 21, or 22 must be rotatorily driven, what has been said in connection with FIGS. 6 and 7 should be correspondingly applied to this embodiment.

With the presence of only one distribution cylinder 21 to be driven, driving in the axial direction can be simplified since, as represented in FIG. 11, the first coupler 54 from the previous preferred embodiments is directly hingedly connected with the coupling 63 of the distribution cylinder 21.

Figure 12:
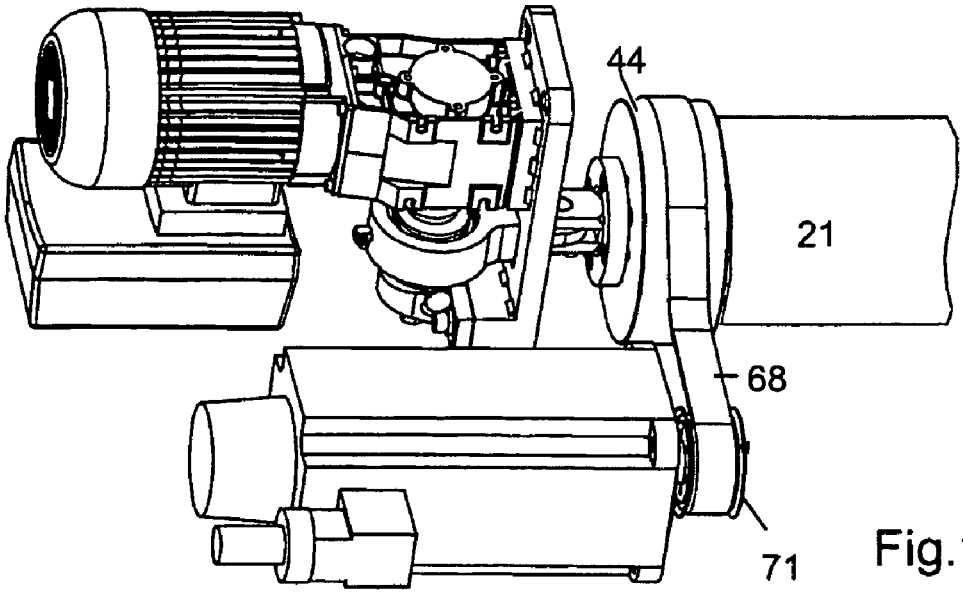
Figure 13:
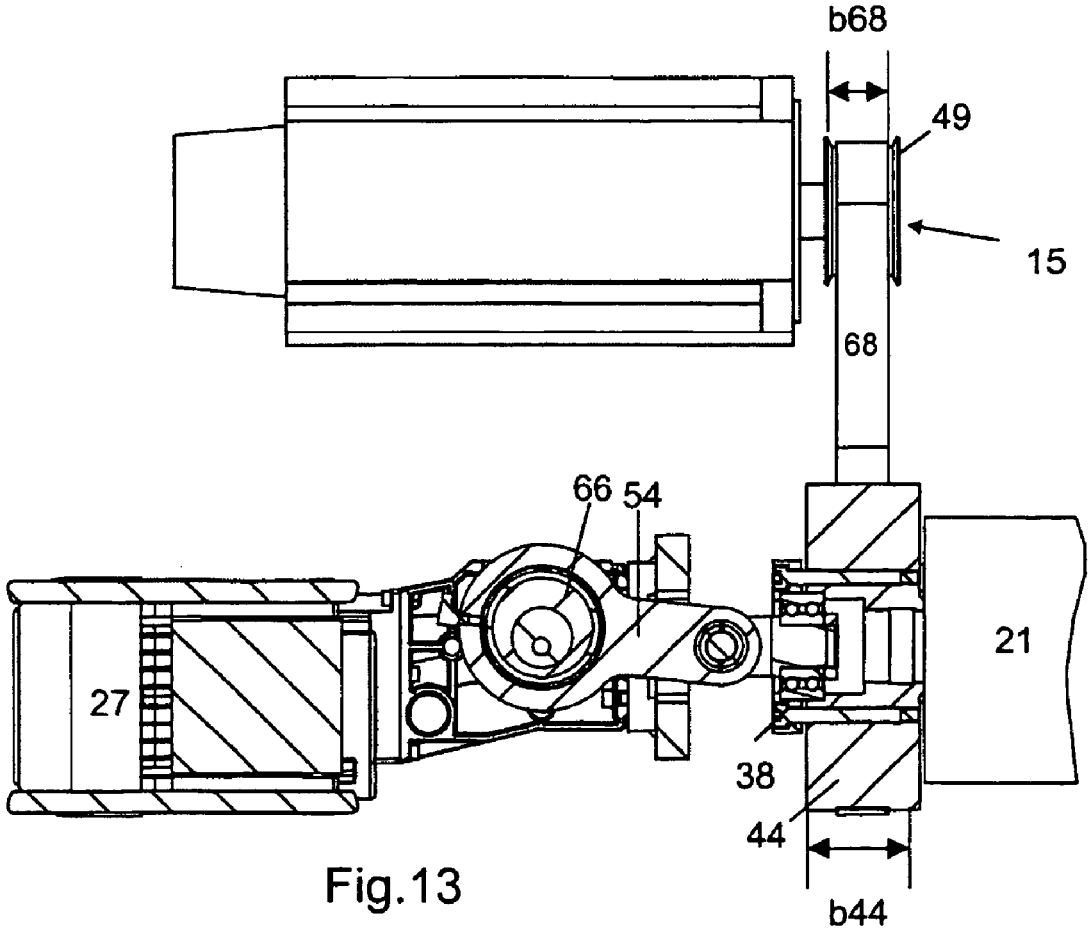

A second preferred embodiment of the rotatory drive mechanism of the dampening unit 06, as seen in FIGS. 12 and 13, corresponds to the principle of the second preferred embodiment of the rotatory drive mechanism of the inking unit 02, as seen in FIGS. 8 and 9. The drive wheel 44 again has a width b44 corresponding at least to the width b68 of the traction mechanism 68 plus a maximal amplitude A, which is not specifically represented, of the stroke of the distribution cylinder 21, 22.

In this preferred embodiment, the dampening unit 06 also has only one distribution cylinder 21. In the case of several distribution cylinders 21, 22, the discussion set forth in connection with FIGS. 10 and 11 correspondingly applies. The drive mechanism for generating the stroke corresponds to that of the first preferred embodiment of the dampening unit 06.

Figure 14:
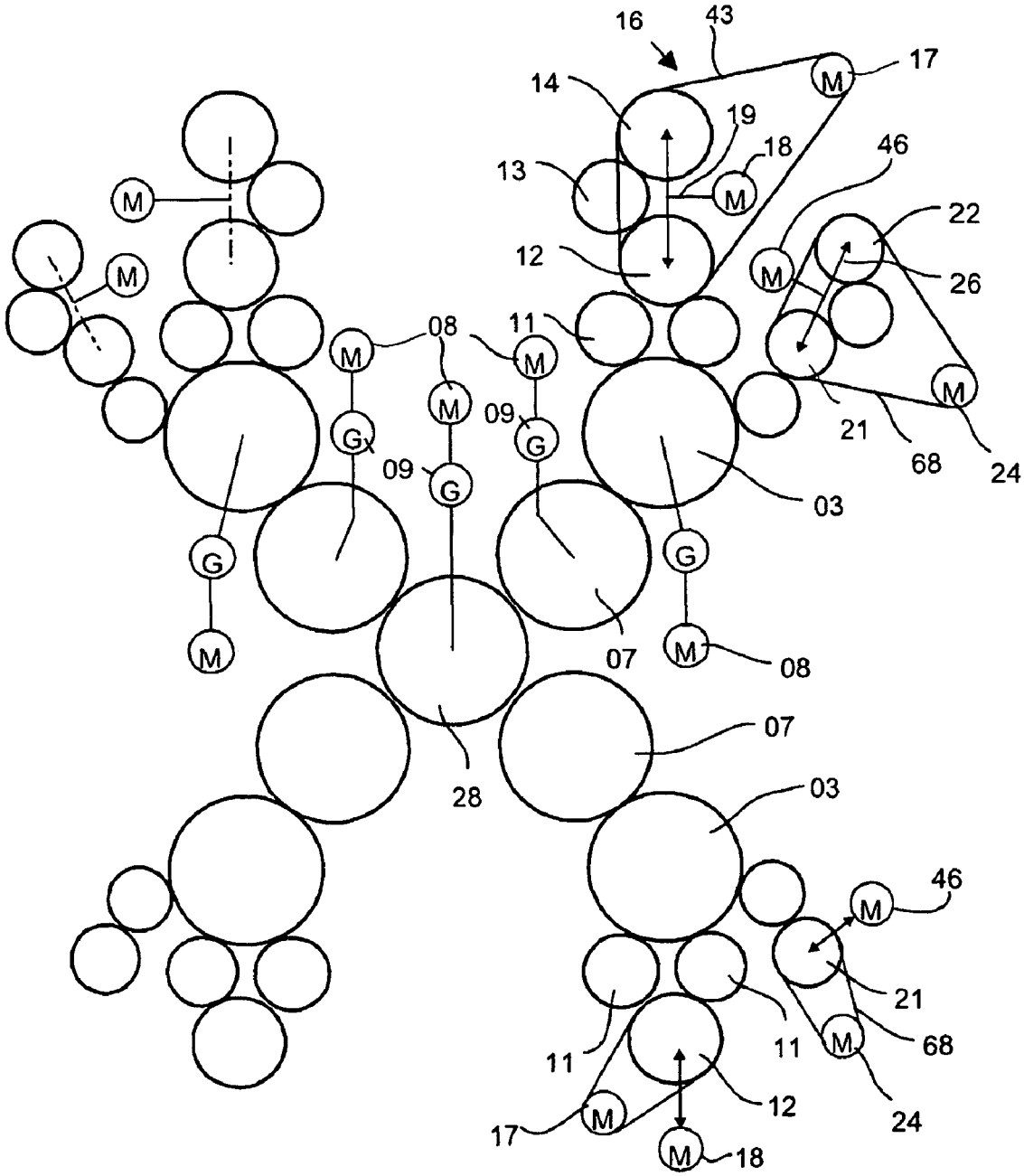

The drive mechanism of each of the inking and dampening units 02, 06 of the printing unit, which printing unit is embodied as satellite printing unit, is represented in FIG. 14. This printing unit has at least one cylinder 28, specifically the counter-pressure cylinder 28, which is embodied as a satellite cylinder 28 and which satellite cylinder 28 is assigned to at least two printing groups 01. Here, the printing group cylinders 03, 07, and the satellite cylinder 28 are each individually driven by the drive motor 08 via a gear 09. The gears 09 are again only schematically represented in FIG. 14, and can be reduction gears, such as, for example planetary gears 09, which gears 09 are arranged axially between the drive motor 08 and the cylinders 03, 07, 28. But this gear 09 can also be a pinion gear working together with a drive wheel as the gear wheel connection, or a belt train.

The drive mechanism of a dampening unit 06 having two distribution cylinders 21, 22 has been represented, by way of example, at the upper right of this satellite printing unit. The mutual rotatory drive of the two distribution cylinders 21, 22 via the traction mechanism 68 by use of the drive motor 24, and the axial drive of the distribution cylinders 21, 22 via a gear, in particular a crank gear, is provided in the manner mentioned above in connection with the inking system 02. The distribution cylinders 12, 14 of the inking unit 06 are embodied in accordance with FIG. 5.

The drive mechanism of the inking unit 02 having merely one distribution cylinder 21 is represented, by way of example, on the lower right. Rotatory driving and the movement in the axial direction takes place in a manner corresponding to the dampening system 06 above.

An embodiment of the satellite printing unit, which is not specifically represented, has four printing groups 01 and two satellite cylinders 28. In this case, both satellite cylinders 28 are embodied with their own drive motor 08, for example. However, the discussions set forth above, in connection with the printing group cylinders 03, 07 regarding the individual or paired, direct or indirect cylinder driving, should be applied appropriately to the two satellite cylinders 28.

With all of the present examples, whether utilizing only a single or several back-and-forth moving distribution cylinders 12, 14, 21, 22 which are driven via the traction mechanism 43, 68, the design of the traction mechanism drive has the substantial advantage that the spatial course of the traction mechanism 43, 68 remains substantially fixed in place in relation to the drive motor 17, 24 in spite of the back-and-forth movement of the distribution cylinders 12, 14, 21, 22 to be driven. The drive mechanism is embodied to be non-interfering, even and easy on the material. In a simple manner, the drive motor 17, 24 can be arranged fixed in place on the frame.

In order to preset, or to maintain, the tension of the traction mechanism 43, 68, it is possible, in accordance with a further development of the present invention, to arrange a roller 69, as seen in FIG. 8, which roller 69 is configured to be adjustable or to be prestressed in a manner for guiding the traction mechanism 43, 68.

So that the traction mechanism such as the belt 43 or 68, is not laterally deflected, the drive mechanism includes a guide 71 in at least one location, which guide 71 is arranged at a fixed distance in relation to the drive motor 17, 24 and which acts transversely to the transport direction of the traction mechanism 43, 68. In a preferred embodiment, such a guide 71 is arranged as a flange, or as spaced flanges or lips 71 on the drive wheel 47 of the drive motor 17, 24, and/or on the possibly existing roller 69 as seen in FIGS. 8, 10, 11, 12, 13. In the first preferred embodiment of the inking or dampening units 02, 06, respectively the drive wheel 44 or 46, which is assigned to the distribution cylinder 12, 14, 21, 22, in addition to the drive wheel 47 or to the roller 69, also has such a guide or flange or lip 71, preferably on both sides of the traction mechanism 43, 68. With an embodiment of the present invention, in accordance with the second preferred embodiment such a guide 71 at the drive wheel 44, 46, respectively can be omitted, or such guides 71 should be distanced or spaced far enough apart so that the traction mechanism 43 or 68 can turn without interference over the entire width b44 required for the amplitude A of the axial movement of the distribution cylinder.

If there is no requirement for independence of the rotatory drive mechanisms of the inking and dampening units 02, 06 then, in a particularly cost-effective embodiment, the distribution cylinders 12, 14 of the inking unit 02, and the distribution cylinder or cylinders 21, 22 of the dampening unit 06 of a printing group 01 can all be driven together by the use of a single traction mechanism 43, in particular in a uniform direction.

The rotatory driving of the distribution cylinders 12, 14, and 21, 22 by use of the drive motor 17, as well as the associated components such as, for example the gear 16, 23, and the axial driving of the distribution cylinders 12, 14, 21, 22 by use of the drive motor 18, 27, as well as the associated components, such as, for example the gear 19, 26, for the axial movement, are represented in FIGS. 6 to 13 on the same side of the distribution cylinders 12, 14, and 21, 22, but in an advantageous further development they can be arranged on sides of the press, or at front ends of the friction cylinders 12, 14, 21, 22, which are different from each other, such as is described in connection with FIGS. 3 and 4, for example.

In advantageous embodiments depending on the case of their application, the distribution cylinder or cylinders 12, 14, or 21, 22 of the inking or dampening units 02, 06, respectively can be axially driven individually or together in other ways than in the above examples.

Figure 15:
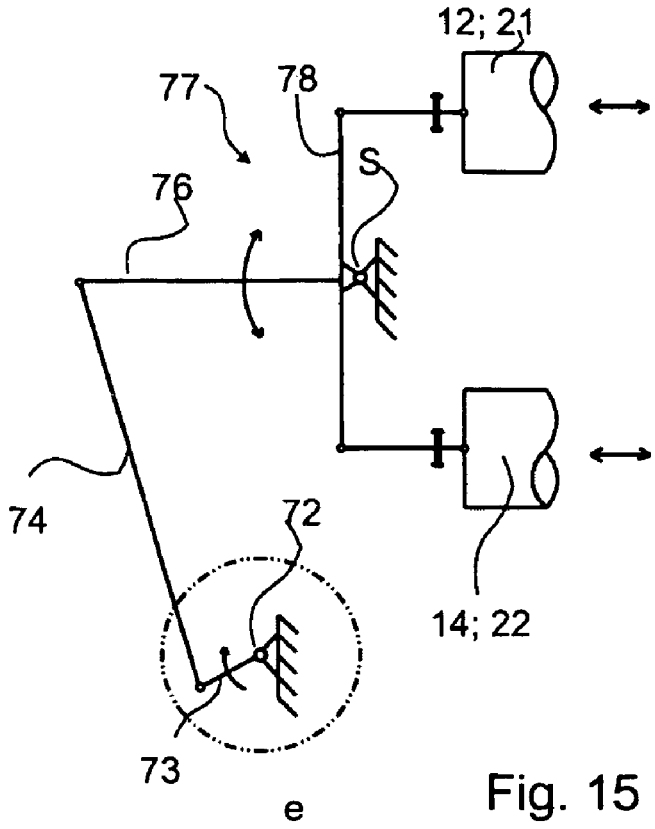

As represented in FIG. 15, axial driving of two distribution cylinders 12, 14, or 21, 22 can take place in accordance with the principle of a cam rocker from the not specifically represented drive motor 18, or 27 to a shaft 72, which shaft 72 is connected, in a torsion-proof manner, with a rotating coupler 73 constituting an eccentricity "e". The end of the rotating coupler 73 is hingedly connected with a first end of a further coupler 74, whose second end is hingedly connected with one arm 76 of a three-armed lever 77. The three-armed lever 77 is seated pivotable around a pivot axis S fixed on the frame, wherein each of the two free arms 78, 79 of the three-armed lever 77 is hingedly connected with an end of the distributing cylinder 12, 14, 21, 22. As described above, the connection between the distribution cylinder 12, 14, or 21, 22 and the three-armed lever 77 permits a rotating movement of the distributing cylinders 12, 14, or 21, 22 relative to the three-armed lever 77. The rotating coupler 74 and the arm 76 constitute a rocker. The rotating coupler 73 can also be embodied as a drive wheel, as indicated in dashed lines, to which rotating coupler 73 the other coupler 74 is eccentrically hinged.

Figure 16:
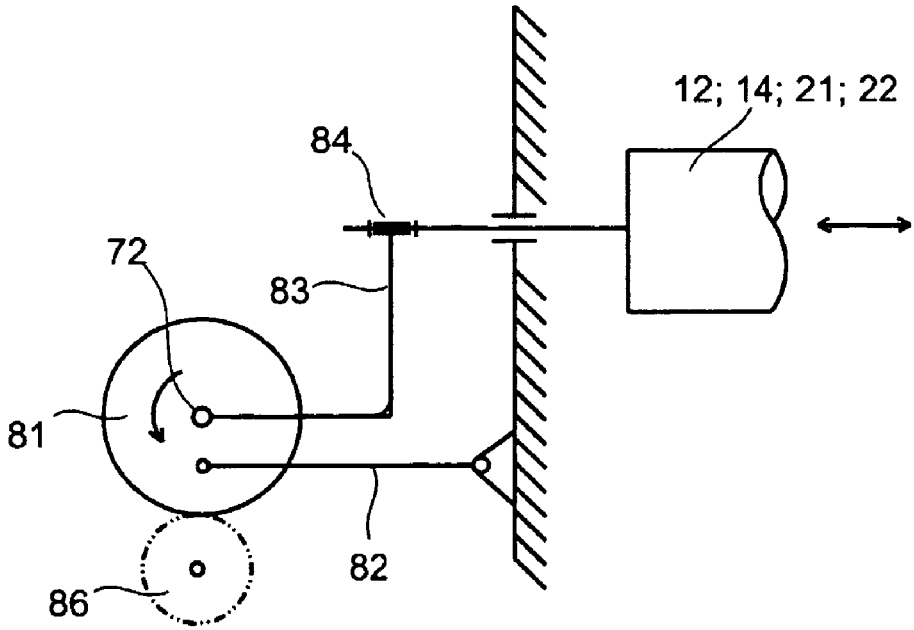

As schematically represented in FIG. 16, the axial driving of one of the distribution cylinders 12, 14, or 21, 22 can extend from the not specifically represented drive motor 18, 27 via the shaft 72 to a drive wheel 81, which is hingedly connected eccentrically "e" around its centered shaft 72 with a coupler 82. The other end of the coupler 82 is hingedly fixed in place on the frame. In the course of the rotation of the drive wheel 81, the drive wheel 81 is cyclically pushed away from the frame and moves the distribution cylinder 12, 14, or 21, 22 in the axial direction via a driver 83 and a bearing 84 with limit stops. The drive motor 08 can be arranged fixed in place with respect to the driver 83, or with respect to the axis of rotation of the drive wheel 81, and make the oscillating movement along with them. The drive wheel 81 can also be driven via a positive drive connection between the drive wheel 81 and a pinion 86 that is driven by the drive motor 18, 27, provided the tooth arrangement of the two is appropriately configured in order to assure sufficient engagement in spite of the lateral movement of the drive wheel 81.

Figure 17:
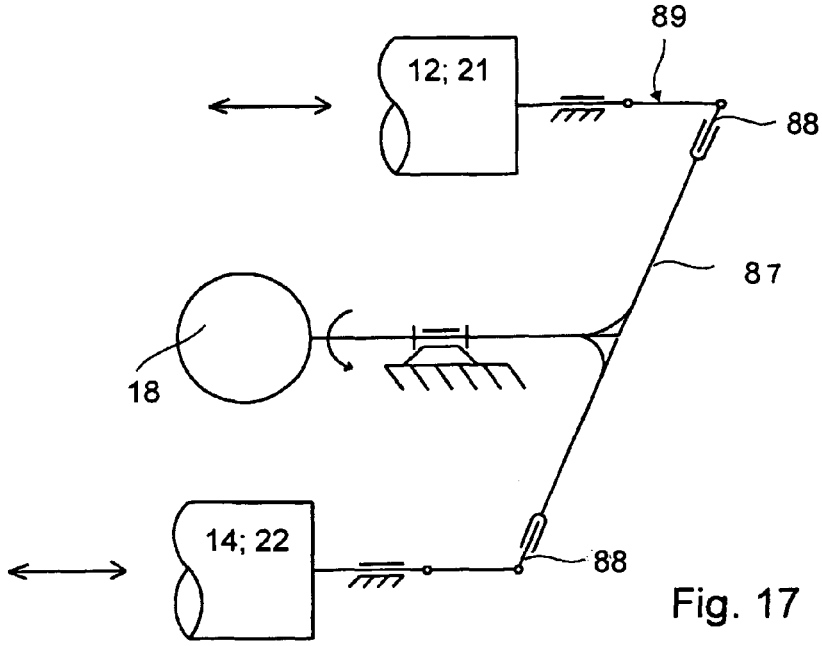

FIG. 17 shows a variation for axial driving, wherein a swash plate 87 is rotatorily driven by the drive motor 18, 27. The tumbling motion of swash plate 87 is transmitted, as an axial movement, via the driver 88 and the coupler 89 to one or two distribution cylinder 12,14, 21, 22.

Figure 18:
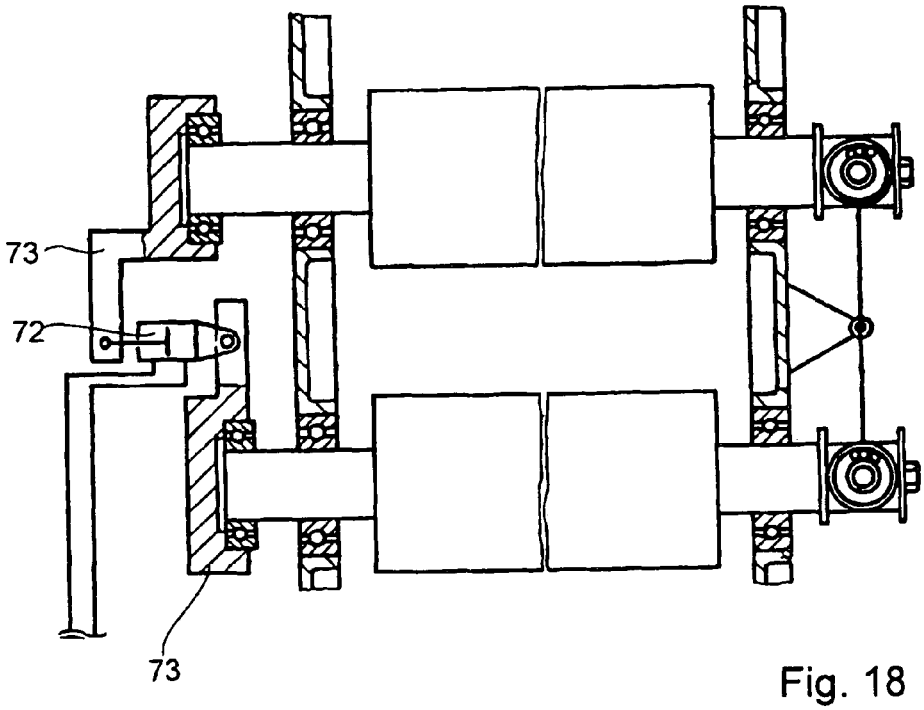

In the variation of the present invention shown in FIG. 18, the drive mechanism for accomplishing the axial movement of one or of several distribution cylinders 12, 14, 21, 22 is embodied as a work cylinder 91, which work cylinder 91 can be acted upon by a pressure medium, and in particular as a dual-chamber cylinder 91. If, for example, two distribution cylinders 12, 14, 21, 22 are to be driven simultaneously, cylinder 91 is seated between two drivers 92, each of which is connected, via a bearing 93, with the distribution cylinders 12, 14, 21, 22.

Figure 19:
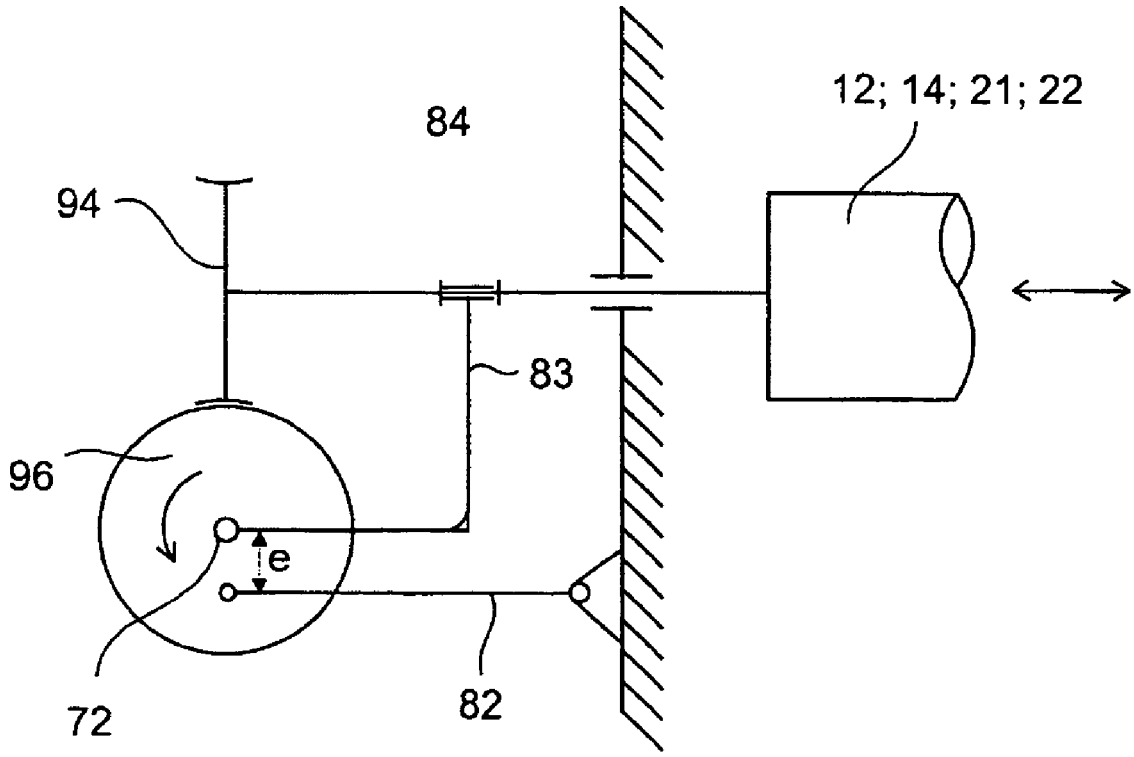

In a variation of the preferred embodiment shown in FIG. 16 and represented in FIG. 19, the distribution cylinder 12, 14, or 21, 22 is rotatorily driven by a drive motor 17, 24, which is not specifically represented here, which drive motor 17, 24 is mechanically independent of the printing group cylinders 03, 07, 28. The distribution cylinder 12, 14 or 21, 22, but is axially driven without a specially provided drive mechanism 18, 27. The axial stroke is provided here by the rotation of the distribution cylinder 12, 14, 21, 22 via a positive gear 94, 96 consisting of, for example, a worm wheel 94, which is connected, fixed against relative rotation, with the distribution cylinder 12, 14, 21, 22, and of a worm 96. The worm wheel 94, which now rotates around the shaft 72, has the eccentric "e" hinging of the coupler 82 which, in the same way as described in connection with FIG. 16, is cyclically pushed off the frame and moves the distribution cylinder 12, 14, 21, 22 in the axial direction via a driver 83 and a bearing 84 with limit stops.

In another embodiment, which is not specifically represented the drive mechanism 18, 27 as one can also be embodied as a linear motor 27, or based on magnetic forces.

Figure 20:
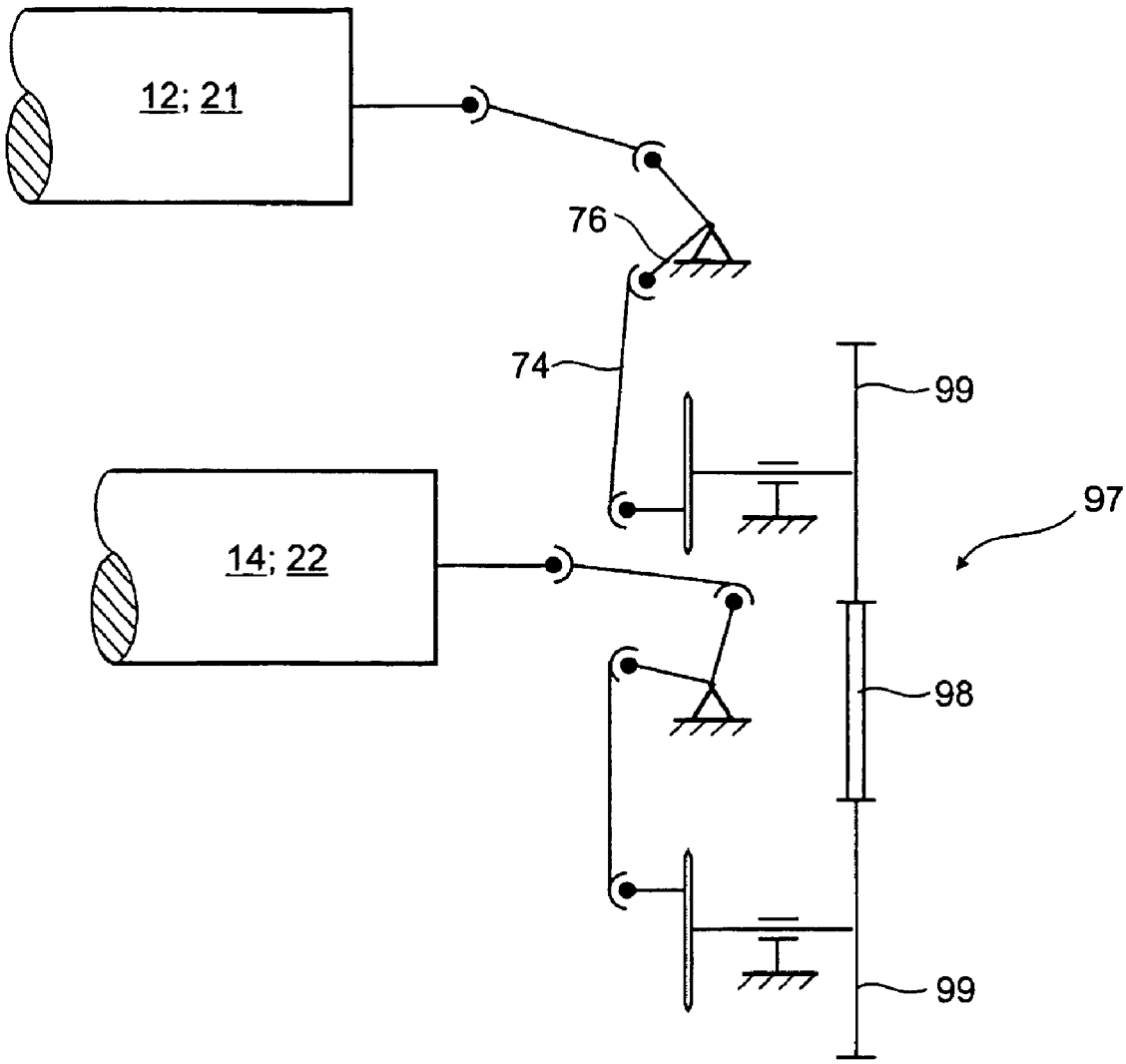

In an embodiment of the present invention, as represented in FIG. 20, the axial drive mechanisms of two distribution cylinders 12, 14, or 21, 22 can be driven by a common drive mechanism 18, 27, in particular a drive motor 18, 27, and can be coupled with each other by a traction mechanism gear, for example a belt drive 97, instead of a shaft, such as the shaft 32 shown in FIG. 6. Here, the belt drive 97 can have one V-belt 99 for each distribution cylinder 12, 14, or 21, 22 to be axially driven, for example, which V-belt 99 in turn drives the respective distribution cylinder 12, 14, or 21, 22 via at least one crank drive 101. The pulleys 99 are driven by a belt 98, for example a toothed belt 98 or a V-belt, by the drive motor 18, 46, not represented in FIG. 20, which drives the belt 98. The crank drive 101 can also be designed in another way than the one represented, which has a rocker.

Figure 21:
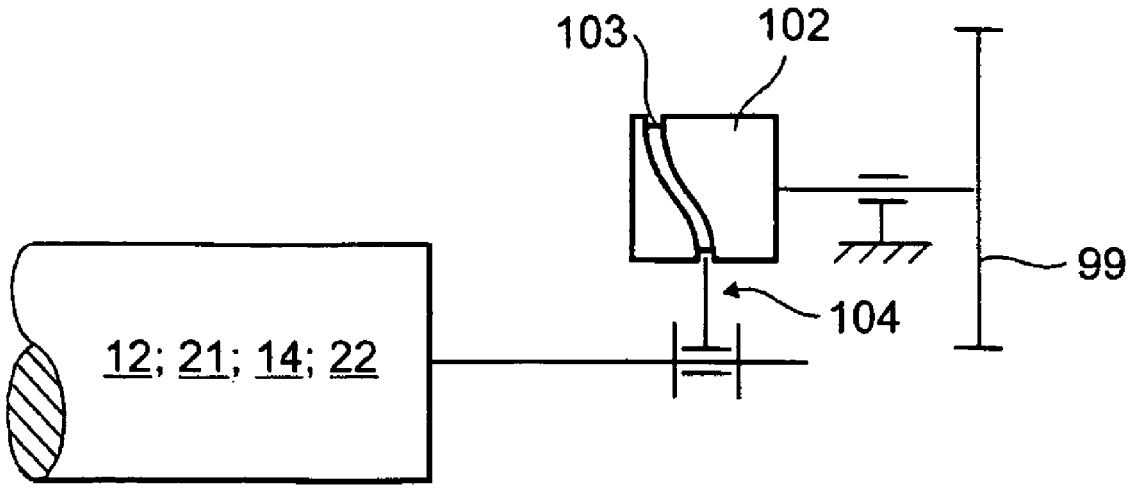

As shown schematically in FIG. 21, a disk 102, which may be, for example, a cam disk 102 having a circumferential curve-shaped groove 103, can be driven by the pulley 99. The cam disk 102 works together with a limit stop 104, for example a driver 104 that is connected with the distribution cylinder 12, 14, 21, 22. The driver 104 can be embodied in various ways but, viewed in the axial direction of the distribution cylinder, must be fixedly connected with the latter. Several of these disks 102 of different distribution cylinders 12, 14, 21, 22 can be driven by a traction mechanism 98. In a variation, axial driving via a cam disk 102 can also take place in the reversed manner in that the cam disk 102 is in a rotatory drive connection with the distribution cylinder 12, 14, 21, 22, and its circumferential groove 103 acts together with a limit stop 104 fixed on the frame. In that case, the number of revolutions of the cam disk 102 can be changed in relation to the number of revolutions of the distribution cylinder 12, 14, 21, 22 by use of the drive motor 18, 27, for example via a differential gear or a so-called harmonic drive, such as a gear embodied with an internally geared wheel and a deformable externally geared wheel, which rotates within it.

In general, in an advantageous embodiment of drive mechanisms by the use of traction mechanisms 43, 46, a variation is of advantage wherein, besides the traction mechanism gear, either no gear wheel connections at all, or only individually encapsulated toothed gears, for example reduction gears and/or attached gears are provided in the respective drive train. In this way, no extended oil chamber is needed. Alternatively to this, it would be necessary to encapsulate the entire drive train.

The above described embodiments of the axial drive mechanism can also be alternatingly combined with the variations represented in FIGS. 1 to 14 for drive mechanisms of the printing group cylinders 03, 07, 28 of the inking and dampening units 02, 06, as well as those of the gears 09, 16, 23, 19, 26, 31 in accordance with requirements.

While preferred embodiments of drives for a printing group, in accordance with the present invention, have been set forth fully and completely hereinabove, it will be apparent to one of skill in the art that various changes in, for example the sizes of the cylinders, the type of materials being printed, and the like could be made without departing from the true spirit and scope of the present invention which is accordingly to be limited only by the appended claims.

This invention claimed is:

1. A drive mechanism of a printing group comprising:

at least one printing group cylinder;

at least one rotating body having a longitudinal axis;

means supporting said at least one rotating body for rotation about said longitudinal axis and for movement in an axial direction of said longitudinal axis;

a rotating drive mechanism usable for rotating said rotating body;

an axial drive mechanism for generating an axial stroke for moving said rotating body in said axial direction;

a first drive motor for said rotating drive mechanism, said first drive motor being mechanically independent of a first drive mechanism of said printing group cylinder and;

a drive wheel connected to said rotating body in a torsion-proof manner and coaxially with said rotating body, and further including a traction mechanism between said drive wheel and said first drive motor.

2. The drive mechanism of claim 1 wherein said rotating body has a first end and a second end, wherein said rotating drive mechanism is arranged at said first end and further wherein said axial drive mechanism is arranged at said second end.

3. The drive mechanism of claim 2 wherein said rotating drive mechanism and said axial drive mechanism each include a gear.

4. The drive mechanism of claim 2 wherein said rotating drive mechanism and said axial drive mechanism each include a drive motor.

5. The drive mechanism of claim 1 further including a gear and a crank drive for use with said axial drive mechanism.

6. The drive mechanism of claim 1 further including a second drive mechanism for said printing group, said second drive mechanism being mechanically independent of said first drive mechanism.

7. The drive mechanism of claim 1 wherein said at least one rotating body is a roller of at least one of an inking unit and a dampening unit.

8. The drive mechanism of claim 1 wherein said at least one printing group cylinder is a forme cylinder and further including a second printing group cylinder, said second printing group cylinder being a transfer cylinder, said forme cylinder and said transfer cylinder being each driven mechanically independently of each other by a respective drive motor and gear, each of which is closed and encapsulated.

9. The drive mechanism of claim 1 wherein said at least one printing group cylinder is a forme cylinder and further including a second printing group cylinder, said second printing group cylinder being a transfer cylinder, said forme cylinder and said transfer cylinder being driven together by a common gear which is closed and encapsulated.

10. The drive mechanism of claim 1 wherein said drive wheel is a pulley and said traction mechanism is a toothed belt.

11. The drive mechanism of claim 1 wherein said at least one rotating body is a distribution cylinder of a dampening unit.

12. The drive mechanism of claim 1 wherein said at least one rotating body is a distribution cylinder of an inking unit.

13. The drive mechanism of claim 1 wherein said drive wheel has a first width and said traction mechanism has a second width, said first width being greater than said second width, said traction mechanism remaining in a spatial plane during said axial stroke of said rotating body.

14. The drive mechanism of claim 13 wherein said axial drive mechanism for generating said axial stroke is mechanically independent of said first drive mechanism and said rotating drive mechanism.

15. The drive mechanism of claim 1 wherein said drive wheel is fixedly connected with said rotating body in said axial direction.

16. The drive mechanism of claim 15 wherein said drive wheel has a drive wheel width, said traction mechanism has a traction mechanism width and said axial stroke has a stroke amplitude, said drive wheel width corresponding to at least a sum of said traction mechanism width and said stroke amplitude.

17. The drive mechanism of claim 1 wherein said drive wheel is connected to said at least one rotatable body and is movable axially with respect to said at least one rotatable body.

18. The drive mechanism of claim 17 further including at least one driver connection between said drive wheel and said at least one rotating body, said at least one driver connection acting in said rotating direction.

19. The drive mechanism of claim 1 wherein said axial drive mechanism includes a gear interposed between said axial drive mechanism and said at least one rotating body.

20. The drive mechanism of claim 19 wherein said gear is a crank drive.

21. The drive mechanism of claim 1 wherein said axial drive mechanism includes an axial stroke drive motor.

22. The drive mechanism of claim 1 wherein said axial drive mechanism includes a work cylinder adapted to be acted on by a pressure medium.

23. The drive mechanism of claim 1 wherein said axial drive mechanism includes a rotating swash plate and drivers.

24. The drive mechanism of claim 1 wherein said axial drive mechanism includes an eccentrically driven rocker.

25. The drive mechanism of claim 1 wherein said axial drive mechanism includes a cam disk.

26. The drive mechanism of claim 25 further including an axial drive mechanism drive motor driving said cam disk for modulating relative angular velocity between said rotating body and said cam disk.

27. The drive mechanism of claim 1 wherein at least one of said first and second rotating bodies is a distribution cylinder of an inking unit.

28. A drive mechanism of a printing group comprising:

at least one printing group cylinder;

at least one rotating body having a longitudinal axis;

means supportina said at least one rotating body for rotation about said longitudinal axis and for movement in an axial direction of said longitudinal axis;

a rotating drive mechanism usable for rotating said rotating body;

an axial drive mechanism for generating an axial stroke for moving said rotating body in said axial direction; and a first drive motor for said rotating drive mechanism, said first drive motor being mechanically independent of a first drive mechanism of said printing group cylinder, said first drive mechanism including a second drive motor, a first gear associated with said first drive motor and a second gear associated with said second drive motor, said first and second gears being mechanically independent, said first gear including a traction mechanism gear, said second gear being an independently closed, encapsulated gear.

29. The drive mechanism of claim 28 wherein said traction gear mechanism includes a traction mechanism and a drive wheel, said drive wheel being connected coaxially with said rotating body.

30. The drive mechanism of claim 28 further including a second drive mechanism for said printing group, said second drive mechanism being mechanically independent of said rotating drive mechanism and of said axial drive mechanism.

31. The drive mechanism of claim 28 wherein said rotating body has a first end and a second end, wherein said rotating drive mechanism is arranged at said first end and further wherein said axial drive mechanism is arranged at said second end.

32. The drive mechanism of claim 31 wherein said at least one rotating body is a distribution cylinder of a dampening unit.

33. The drive mechanism of claim 31 wherein said at least one rotating body is a distribution cylinder of an inking unit.

34. The drive mechanism of claim 31 wherein said rotating drive mechanism and said axial drive mechanism each include a gear.

35. The drive mechanism of claim 31 wherein said rotating drive mechanism and said axial drive mechanism each include a drive motor.

36. The drive mechanism of claim 28 further including a gear and a crank drive for use with said axial drive mechanism.

37. The drive mechanism of claim 28 further including a drive wheel connected to said rotating body in a torsion-proof manner and coaxially with said rotating body, and further including a traction mechanism between said drive wheel and said first drive motor.

38. The drive mechanism of claim 37 further including a second drive mechanism for said printing group, said second drive mechanism being mechanically independent of said first drive mechanism.

39. The drive mechanism of claim 37 wherein said drive wheel is a pulley and said traction mechanism is a toothed belt.

40. The drive mechanism of claim 37 wherein said drive wheel has a first width and said traction mechanism has a second width, said first width being greater than said second width, said traction mechanism remaining in a spatial plane during said axial stroke of said rotating body.

41. The drive mechanism of claim 37 wherein said drive wheel is fixedly connected with said rotating body in said axial direction.

42. The drive mechanism of claim 40 wherein said axial drive mechanism for generating said axial stroke is mechanically independent of said first drive mechanism and said rotating drive mechanism.

43. The drive mechanism of claim 41 wherein said drive wheel has a drive wheel width, said traction mechanism has a traction mechanism width and said axial stroke has a stroke amplitude, said drive wheel width corresponding to at least a sum of said traction mechanism width and said stroke amplitude.

44. The drive mechanism of claim 37 wherein said drive wheel is connected to said at least one rotatable body and is movable axially with respect to said at least one rotatable body.

45. The drive mechanism of claim 44 further including at least one driver connection between said drive wheel and said at least one rotating body, said at least one driver connection acting in said rotating direction.

46. The drive mechanism of claim 28 wherein said at least one rotating body is a roller of at least one of an inking unit and a dampening unit.

47. The drive mechanism of claim 28 wherein said first drive mechanism includes a second drive motor, a first gear associated with said first drive motor and a mechanically independent, said first gear including a traction mechanism gear, said second gear being an independently closed, encapsulated gear.

48. The drive mechanism of claim 47 wherein said traction gear mechanism includes a traction mechanism and a drive wheel, said drive wheel being connected coaxially with said rotating body.

49. The drive mechanism of claim 28 further including a second drive mechanism for said printing group, said second drive mechanism being mechanically independent of said rotating drive mechanism and of said axial drive mechanism.

50. The printing group of claim 28 wherein said printing group includes a second rotating body supported for rotation about a longitudinal axis and movable in an axial direction of said longitudinal axis.

51. The drive mechanism of claim 50 further including a drive wheel connected to each of said first and second rotating bodies in a torsion-proof manner and coaxially with each said rotating body, and further including a traction drive mechanism.

52. The drive mechanism of claim 51 wherein said traction drive mechanism is a common traction drive mechanism which loops around each drive wheel connected to its respective one of said first and second rotating bodies.

53. The drive mechanism of claim 52 wherein said at least first and second rotating bodies are included in at least one of an inking unit and a dampening unit.

54. The drive mechanism of claim 53 wherein said first and second rotating bodies are rotatably driven by said first drive motor and are moved in said axial direction by said axial drive mechanism.

55. The drive mechanism of claim 50 wherein said first and second rotating bodies are rotatably driven by said first drive motor and are moved in said axial direction by said axial drive mechanism.

56. The drive mechanism of claim 50 wherein said at least first and second rotatable bodies each have an axial drive mechanism, said at least first and second axial drive mechanisms being coupled with each other by a shaft.

57. The drive mechanism of claim 50 wherein said at least first and second rotatable bodies each have an axial drive mechanism, said at least first and second axial drive mechanisms being coupled with each other by a traction mechanism gear.

58. The drive mechanism of claim 28 wherein said at least one printing group cylinder is a forme cylinder and further including a second printing group cylinder, said second printing group cylinder being a transfer cylinder, said forme cylinder and said transfer cylinder being each driven mechanically independently of each other by a respective drive motor and gear, each of which is closed and encapsulated.

59. The drive mechanism of claim 28 wherein said at least one printing group cylinder is a forme cylinder and further including a second printing group cylinder, said second printing group cylinder being a transfer cylinder, said forme cylinder and said transfer cylinder being driven together by a common gear which is closed and encapsulated.

60. The drive mechanism of claim 28 wherein said axial drive mechanism includes a gear interposed between said axial drive mechanism and said at least one rotating body.

61. The drive mechanism of claim 60 wherein said gear is a crank drive.

62. The drive mechanism of claim 28 wherein said axial drive mechanism includes an axial stroke drive motor.

63. The drive mechanism of claim 28 wherein said axial drive mechanism includes a work cylinder adapted to be acted on by a pressure medium.

64. The drive mechanism of claim 28 wherein said axial drive mechanism is a linear motor.

65. The drive mechanism of claim 28 wherein said axial drive mechanism is based on magnetic forces.

66. The drive mechanism of claim 28 wherein said axial drive mechanism includes a rotating swash plate and drivers.

67. The drive mechanism of claim 28 wherein said axial drive mechanism includes an eccentrically driven rocker.

68. The drive mechanism of claim 28 wherein said axial drive mechanism includes a cam disk.

69. The drive mechanism of claim 68 further including an axial drive mechanism drive motor driving said cam disk for modulating relative angular velocity between said rotating body and said cam disk.

70. A drive mechanism of a printing group comprising:

at least one nrinting group cylinder;

a first rotating body having a first longitudinal axis;

a second rotating body having a second longitudinal axis;

means supporting each said first and second rotating bodies for rotation about each said longitudinal axis and for movement in an axial direction of each said longitudinal axis;

a rotating drive mechanism usable for rotating said first and second rotating bodies and including a drive wheel connected to each of said first and second rotating bodies in a torsion-proof manner and coaxially with each said rotating body, and further including a traction drive mechanism;

an axial drive mechanism for generating an axial stroke for moving each said rotating body in said axial direction; and a first drive motor for said rotating drive mechanism, said first drive motor being mechanically independent of a first drive mechanism of said printing group cylinder.

71. The drive mechanism of claim 70 wherein said traction drive mechanism is a common traction drive mechanism which loops around each drive wheel connected to its respective one of said first and second rotating bodies.

72. The drive mechanism of claim 71 wherein said first and second rotating bodies are included in at least one of an inking unit and a dampening unit.

73. The drive mechanism of claim 72 wherein said first and second rotating bodies are rotatably driven by said first drive motor and are moved in said axial direction by said axial drive mechanism.

74. A drive mechanism of a printing groun comprising:

at least one printing group cylinder;

a first rotating body having a first longitudinal axis;

a second rotating body having a second longitudinal axis;

means supporting each said first and second rotating bodies for rotation about each said longitudinal axis and for movement in an axial direction of each said longitudinal axis;

a rotating drive mechanism usable for rotating said first and second said rotating bodies;

an axial drive mechanism for generating an axial stroke for moving each said rotating body in said axial direction; and a first drive motor for said rotating drive mechanism, said first drive motor being mechanically independent of a first drive mechanism of said printing group cylinder, said first and second rotating bodies being rotatably driven by said first drive motor and being moved in said axial direction by said axial drive mechanism.

75. The drive mechanism of claim 74 wherein each said first and second rotating body has a first end and a second end, wherein said rotating drive mechanism is arranged at said first end and further wherein said axial drive mechanism is arrange at said second end.

76. The drive mechanism of claim 75 wherein each said first and second rotating drive mechanism and said axial drive mechanism each include a gear.

77. The drive mechanism of claim 75 wherein each said first and second rotating drive mechanism and said axial drive mechanism each include a drive motor.

78. The drive mechanism of claim 74 further including a gear and a crank drive for use with said axial drive mechanism.

79. The drive mechanism of claim 74 further including a drive wheel connected to each said first and second rotating body in a torsion-proof manner and coaxially with each said first and second rotating body, and further including a traction mechanism between said drive wheel and said first drive motor.

80. The drive mechanism of claim 79 further including a second drive mechanism for said printing group, said second drive mechanism being mechanically independent of said first drive mechanism.

81. The drive mechanism of claim 79 wherein said drive wheel is a pulley and said traction mechanism is a toothed belt.

82. The drive mechanism of claim 79 wherein each said drive wheel has a first width and said traction mechanism has a second width, said first width being greater than said second width, said traction mechanism remaining in a spatial plane during said axial stroke of said rotating body.

83. The drive mechanism of claim 82 wherein said axial drive mechanism for generating said axial stroke is mechanically independent of said first drive mechanism and said rotating drive mechanism.

84. The drive mechanism of claim 79 wherein each said drive wheel is fixedly connected with its one of said first and second rotating body in said axial direction.

85. The drive mechanism of claim 84 wherein each said drive wheel has a drive wheel width, said traction mechanism has a traction mechanism width and said axial stroke has a stroke amplitude, each said drive wheel width corresponding to at least a sum of said traction mechanism width and said stroke amplitude.

86. The drive mechanism of claim 79 wherein each said drive wheel is connected to its one of said first and second rotating body and is movable axially with respect to said one of said first and second rotating body.

87. The drive mechanism of claim 86 further including at least one driver connection between each said drive wheel and said one of said first and second rotating body, said at least one driver connection for each said drive wheel acting in said rotating direction.

88. The drive mechanism of claim 74 wherein each said first and second rotating body is a roller of at least one of an inking unit and a dampening unit.

89. The drive mechanism of claim 74 wherein said first drive mechanism includes a second drive motor, a first gear associated with said first drive motor and a second gear associated with said second drive motor, said first and second gears being mechanically independent, said first gear including a traction mechanism gear, said second gear being an independently closed, encapsulated gear.

90. The drive mechanism of claim 89 wherein said traction gear mechanism includes a traction mechanism and a drive wheel, said drive wheel being connected coaxially with said rotating body.

91. The drive mechanism of claim 89 further including a second drive mechanism for said printing group, said second drive mechanism being mechanically independent of said rotating drive mechanism and of said axial drive mechanism.

92. The drive mechanism of claim 74 further including a drive wheel connected to each said first and second rotating body in a torsion-proof manner and coaxially with each said first and second rotating body, and further including a traction drive mechanism.

93. The drive mechanism of claim 92 wherein said traction drive mechanism is a common traction drive mechanism which loops around each drive wheel connected to its respective one of said first and second rotating bodies.

94. The drive mechanism of claim 93 wherein each said first and second rotating body is included in at least one of an inking unit and a dampening unit.

95. The drive mechanism of claim 74 wherein said at least one printing group cylinder is a forme cylinder and further including a second printing group cylinder, said second printing group cylinder being a transfer cylinder, said forme cylinder and said transfer cylinder being each driven mechanically independently of each other by a respective drive motor and gear, each of which is closed and encapsulated.

96. The drive mechanism of claim 74 wherein said at least one printing group cylinder is a forme cylinder and further including a second printing group cylinder, said second printing group cylinder being a transfer cylinder, said forme cylinder and said transfer cylinder being driven together by a common gear which is closed and encapsulated.

97. The drive mechanism of claim 74 wherein said at least one of said first and second rotating bodies is a distribution cylinder of a dampening unit.

98. The drive mechanism of claim 74 wherein said axial drive mechanism includes a gear interposed between said axial drive mechanism and each said first and second rotating body.

99. The drive mechanism of claim 98 wherein said gear is a crank drive.

100. The drive mechanism of claim 74 wherein said axial drive mechanism includes an axial stroke drive motor.

101. The drive mechanism of claim 74 wherein said axial drive mechanism includes a work cylinder adapted to be acted on by a pressure medium.

102. The drive mechanism of claim 74 wherein said axial drive mechanism is a linear motor.

103. The drive mechanism of claim 74 wherein said axial drive mechanism is based on magnetic forces.

104. The drive mechanism of claim 74 wherein said axial drive mechanism includes a rotating swash plate and drivers.

105. The drive mechanism of claim 74 wherein said axial drive mechanism includes an eccentrically driven rocker.

106. The drive mechanism of claim 74 wherein said axial drive mechanism includes a cam disk.

107. The drive mechanism of claim 106 further including an axial drive mechanism drive motor driving said cam disk for modulating relative angular velocity between each said first and second rotating body and said cam disk.

108. The drive mechanism of claim 74 wherein each said first and second rotating bodies has an axial drive mechanism, said axial drive mechanisms being coupled with each other by a shaft.

109. The drive mechanism of claim 74 wherein each said first and second rotating bodies has an axial drive mechanism, said axial drive mechanisms being coupled with each other by a traction mechanism gear.

110. A drive mechanism of a printing group comprising:

at least one printing group cyiinder;

at least one rotating body having a longitudinal axis;

means supporting said at least one rotating body for rotation about said longitudinal axis and for movement in an axial direction of said longitudinal axis;

a rotating drive mechanism usable for rotating said rotating body;

an axial drive mechanism for generating an axial stroke for moving said rotating body in said axial direction, said axial drive mechanism being based on magnetic forces; and a first drive motor for said rotating drive mechanism, said first drive motor being mechanically independent of a drive mechanism of said printing group cylinder.

111. A drive mechanism of a printing group comprising:

at least one printing group cylinder;

a first rotating body having a first longitudinal axis;

a second rotating body having a second longitudinal axis;

means supporting each said first and second rotating bodies for rotation about each said longitudinal axis and for movement in an axial direction of each said longitudinal axis;

a rotating drive mechanism usable for rotating said first and second rotating bodies;

a first axial drive mechanism for generating a first axial stroke for moving said first rotating body in said axial direction;

a second axial drive mechanism for generating a second axial stroke for moving said second rotating body in said axial direction, said first and second axial drive mechanisms being coupled with each other by a shaft; and a first drive motor for said rotating drive mechanism, said first drive motor being mechanically independent of a first drive mechanism of said printing group cylinder.

112. A drive mechanism of a printing group comprising:

at least one printing group cylinder;

a first rotating body having a first longitudinal axis;

a second rotating body having a second longitudinal axis;

means supporting each said first and second rotating bodies for rotation about each said longitudinal axis and for movement in an axial direction of each said longitudinal axis;

a rotating drive mechanism usable for rotating said first and second rotating bodies;

a first axial drive mechanism for generating a first axial stroke for moving said first rotating body in said axial direction;

a second axial drive mechanism for generating a second axial stroke for moving said second rotating body in said axial direction, said first and second axial drive mechanisms being coupled with each other by a traction gear mechanism; and a first drive motor for said rotating drive mechanism, said first drive motor being mechanically independent of a first drive mechanism of said printing group cylinder.

* * * * *